US012247771B2

(12) United States Patent
Taras

(10) Patent No.: US 12,247,771 B2
(45) Date of Patent: Mar. 11, 2025

(54) SYSTEMS AND METHODS FOR DEFROST OF HEAT PUMP SYSTEMS

(71) Applicant: Daikin Comfort Technologies Manufacturing, L.P., Waller, TX (US)

(72) Inventor: Michael F. Taras, Spring, TX (US)

(73) Assignee: Daikin Comfort Technologies Manufacturing, L.P., Waller, TX (US)

( * ) Notice: Subject to any disclaimer, the term of this patent is extended or adjusted under 35 U.S.C. 154(b) by 240 days.

(21) Appl. No.: 17/812,235

(22) Filed: Jul. 13, 2022

(65) Prior Publication Data

US 2024/0019185 A1 Jan. 18, 2024

(51) Int. Cl.

| | |
|---|---|
| ***F25B 47/02*** | (2006.01) |
| ***F25B 41/26*** | (2021.01) |
| ***F25B 49/02*** | (2006.01) |

(52) U.S. Cl.

CPC ..... *F25B 47/025* (2013.01); *F25B 41/26* (2021.01); *F25B 49/02* (2013.01); *F25B 2347/02* (2013.01); *F25B 2600/2507* (2013.01); *F25B 2700/02* (2013.01); *F25B 2700/2106* (2013.01)

(58) Field of Classification Search

CPC ..... F25B 41/26; F25B 49/02; F25B 47/025; F25B 2347/02; F25B 2313/02342; F25B 2313/02332; F25B 2313/02322; F25B 2600/2507

See application file for complete search history.

(56) References Cited

U.S. PATENT DOCUMENTS

| | | | | |
|---|---|---|---|---|
| 2014/0026601 | A1* | 1/2014 | Chen | F25B 47/025 62/81 |
| 2015/0338145 | A1 | 11/2015 | Kim et al. | |
| 2018/0372363 | A1* | 12/2018 | Park | F24F 11/63 |
| 2019/0032979 | A1 | 1/2019 | Kasamatsu et al. | |
| 2019/0152294 | A1* | 5/2019 | Peng | B60H 1/00278 |

(Continued)

FOREIGN PATENT DOCUMENTS

| | | | |
|---|---|---|---|
| CN | 202734367 | * | 2/2013 |
| CN | 202734367 U | | 2/2013 |

(Continued)

OTHER PUBLICATIONS

Machine translation KR-2014-014025, published Dec. 22, 2014.*

(Continued)

*Primary Examiner* — Henry T Crenshaw

(74) *Attorney, Agent, or Firm* — K&L Gates LLP

(57) ABSTRACT

The present disclosure relates to a HVAC system operable to use a refrigerant in a refrigerant circuit to heat or cool an indoor space and includes a defrost circuit connected to the refrigerant circuit. The defrost circuit includes a first three-way valve, a defrost line, a defrost passage in an outdoor heat exchanger, and a defrost return line. When the HVAC system is in a defrost mode, a four-way valve is operable to direct the refrigerant flow in a second direction through the outdoor heat exchanger. The first three-way valve is operable to divert some or all of the refrigerant from the refrigerant circuit and through the defrost circuit to defrost the outdoor heat exchanger. The defrost return line returns the diverted refrigerant to the refrigerant circuit upstream of an expansion device and downstream of the indoor heat exchange with respect to the second direction.

20 Claims, 7 Drawing Sheets

(56) References Cited

U.S. PATENT DOCUMENTS

| | | | | |
|---|---|---|---|---|
| 2020/0182487 | A1* | 6/2020 | Jang | F02B 29/04 |
| 2021/0333028 | A1* | 10/2021 | Huang | F25B 49/022 |
| 2022/0307737 | A1* | 9/2022 | Butler | F25B 30/02 |
| 2023/0296296 | A1* | 9/2023 | Taras | F25B 49/00 62/151 |

FOREIGN PATENT DOCUMENTS

| | | | |
|---|---|---|---|
| KR | 2014-014025 | * | 12/2014 |
| KR | 20140145025 | A | 12/2014 |
| KR | 20170127875 | A | 11/2017 |

OTHER PUBLICATIONS

Machine translation CN 202734367 published Feb. 13, 2013.*
Machine translation (Year: 2013).*
Machine translation (Year: 2014).*
International Search Report and Written Opinion dated Oct. 17, 2023 for corresponding PCT Patent Application No. PCT/US2023/025756 filed on Jun. 20, 2023.

* cited by examiner

SYSTEMS AND METHODS FOR DEFROST OF HEAT PUMP SYSTEMS

BACKGROUND

This section is intended to provide relevant background information to facilitate a better understanding of the various aspects of the described embodiments. Accordingly, these statements are to be read in this light and not as admissions of prior art.

A heat pump is a refrigerant system that is typically operable in both cooling and heating modes. While air conditioners are familiar examples of heat pumps, the term "heat pump" is more general and applies to many heating, ventilating, and air conditioning ("HVAC") devices used for space heating or space cooling. When a heat pump is used for heating, it employs the same basic refrigeration-type cycle used by an air conditioner or a refrigerator, but in the opposite direction, releasing heat into the conditioned space rather than the surrounding environment. In this use, heat pumps generally draw heat from cooler external air, water, or from the ground.

In a cooling mode, a heat pump operates like a typical air conditioner, i.e., a refrigerant is compressed in a compressor and delivered to a condenser (or an outdoor heat exchanger). In the condenser, heat is exchanged between a medium such as outside air, water, or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

Reversible heat pumps (generally referred to herein simply as "heat pumps") work in either direction to provide heating or cooling to the internal space as mentioned above. Reversible heat pumps employ a reversing valve to reverse the flow of refrigerant from the compressor through the condenser and evaporation coils. In heating mode, the outdoor coil is an evaporator, while the indoor coil is a condenser. The refrigerant flowing from the evaporator (outdoor coil) carries the thermal energy from outside air (or source such as water, soil, etc.) indoors. Vapor temperature is augmented within the pump by compressing it. The indoor coil then transfers thermal energy (including energy from the compression) with the indoor air, which is then moved around the inside of the building by an air handler. The refrigerant is then allowed to expand, cool, and absorb heat from the outdoor temperature in the outside evaporator, and the cycle repeats. This is a standard refrigeration cycle, save that the "cold" side of the refrigerator (the evaporator coil) is positioned so it is outdoors where the environment is colder.

When operating in the heating mode, heating is being provided to the internal occupant spaces within a building, and thus the outdoor ambient temperatures are relatively cold when the outside evaporator is on the "cold" side of the refrigeration cycle. The combination of cold outdoor ambient temperatures and cold refrigerant within the outside evaporator can result in ice formation on the outside evaporator. The ice formation may be removed by "defrosting" the outside evaporator, to protect the compressor and to maintain the efficiency of heat transfer between the refrigeration system and the outdoor environment. One solution for defrosting the outdoor heat exchanger is to reverse the flow of the refrigerant in the refrigeration cycle so that the outdoor heat exchanger acts as the condenser and the indoor heat exchanger acts as the evaporator. By reversing the refrigerant flow in this manner, the outdoor heat exchanger is placed on the "hot" side of the refrigeration cycle and any ice formation of the outdoor heat exchanger is melted. However, this method of defrosting places the refrigeration system into a cooling mode for the internal spaces within a building, which is not desirable when experiencing colder outdoor ambient temperatures.

SUMMARY

Some embodiments disclosed herein are directed to a HVAC system operable to use a refrigerant to heat or cool an indoor space, the HVAC system includes a compressor, an outdoor heat exchanger, an indoor heat exchanger, an expansion device, and a four-way valve connected together as a refrigerant circuit. The four-way valve is operable to flow the refrigerant through the expansion device in a first direction in a cooling mode and in a second direction, opposite the first direction, in a heating mode. The HVAC system further including a defrost circuit connected to the refrigerant circuit and including a first three-way valve, a defrost line, a defrost passage in the outdoor heat exchanger, and a defrost return line. In addition, when the HVAC system is in a defrost mode, the four-way valve is operable to direct the refrigerant flow in the second direction through the outdoor heat exchanger. Also, the first three-way valve is operable to divert some or all of the refrigerant from the refrigerant circuit and through the defrost circuit to defrost the outdoor heat exchanger. Still further, the defrost return line returns the diverted refrigerant to the refrigerant circuit upstream of the expansion device and downstream of the indoor heat exchange with respect to the second direction.

Other embodiments disclosed herein are directed to a method of defrosting a HVAC system that is operable to use a refrigerant to heat or cool an indoor space. In an embodiment, the method includes compressing the refrigerant with a compressor, flowing the refrigerant in a refrigerant circuit between an indoor heat exchanger an expansion device and an outdoor heat exchanger. The refrigerant flows through the expansion device in a first direction in a cooling mode and in a second direction, opposite the first direction, in a heating mode. When in a defrost mode, the method includes flowing the refrigerant in the second direction in the refrigerant circuit, actuating the first three-way valve to divert some or all of the refrigerant from the refrigerant circuit and through a defrost line, a defrost passage in the outdoor heat exchanger, and a defrost return line. The method further including defrosting the outdoor heat exchanger with the diverted refrigerant in the defrost passage, and flowing the diverted refrigerant in the defrost return line to return the diverted refrigerant to the refrigerant circuit upstream of the expansion device and downstream of the indoor heat exchange with respect to the second direction.

Other embodiments disclosed herein are directed to a multi-circuit HVAC system for use with a first refrigerant and a second refrigerant. The multi-circuit HVAC system includes a first refrigerant circuit for the first refrigerant and includes a first compressor, a first outdoor heat exchanger, a first expansion device, and an indoor heat exchanger. In addition, the multi-circuit HVAC system further includes a second refrigerant circuit for the second refrigerant, where the second refrigerant circuit being fluidically isolated from the first refrigerant circuit. The second refrigerant circuit includes a second compressor, a second outdoor heat exchanger, a second expansion device, and the indoor heat exchanger. In addition, a first defrost circuit connects to and branches from the first refrigerant circuit in two positions. The first defrost circuit includes a first three-way valve, a first defrost line, a first defrost passage in the first outdoor heat exchanger, and a first defrost return line. When the HVAC system is in a defrost mode, the first three-way valve is operable to divert some or all of the first refrigerant from the first refrigerant circuit and through the first defrost circuit to defrost the first outdoor heat exchanger. The first defrost return line returns the diverted first refrigerant to the first refrigerant circuit upstream of the first expansion device and downstream of the indoor heat exchanger.

Still other embodiments disclosed herein are directed to a method of defrosting a multi-circuit HVAC system operable to use a first refrigerant and a second refrigerant to heat or cool an indoor space. The method includes compressing the first refrigerant with a first compressor, flowing the first refrigerant in a first refrigerant circuit between an indoor heat exchanger a first expansion device and a first outdoor heat exchanger. The first refrigerant flows through the first expansion device in a first direction in a cooling mode and in a second direction, opposite the first direction, in a heating mode. The method further includes flowing the second refrigerant in a second refrigerant circuit between the indoor heat exchanger, a second expansion device, and a second outdoor heat exchanger. The second refrigerant flows through the second expansion device in a first direction in a cooling mode and in a second direction, opposite the first direction, in a heating mode. When in a defrost mode, the method further includes flowing the first refrigerant in the second direction in the first refrigerant circuit, actuating the first three-way valve to divert some or all of the first refrigerant from the first refrigerant circuit and through a first defrost line, a first defrost passage in the first outdoor heat exchanger, and a first defrost return line. The method also including defrosting the first outdoor heat exchanger with the diverted first refrigerant in the first defrost passage, and flowing the diverted first refrigerant in the first defrost return line to return the diverted first refrigerant to the first refrigerant circuit upstream of the first expansion device and downstream of the indoor heat exchanger with respect to the second direction.

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

Figure 1:
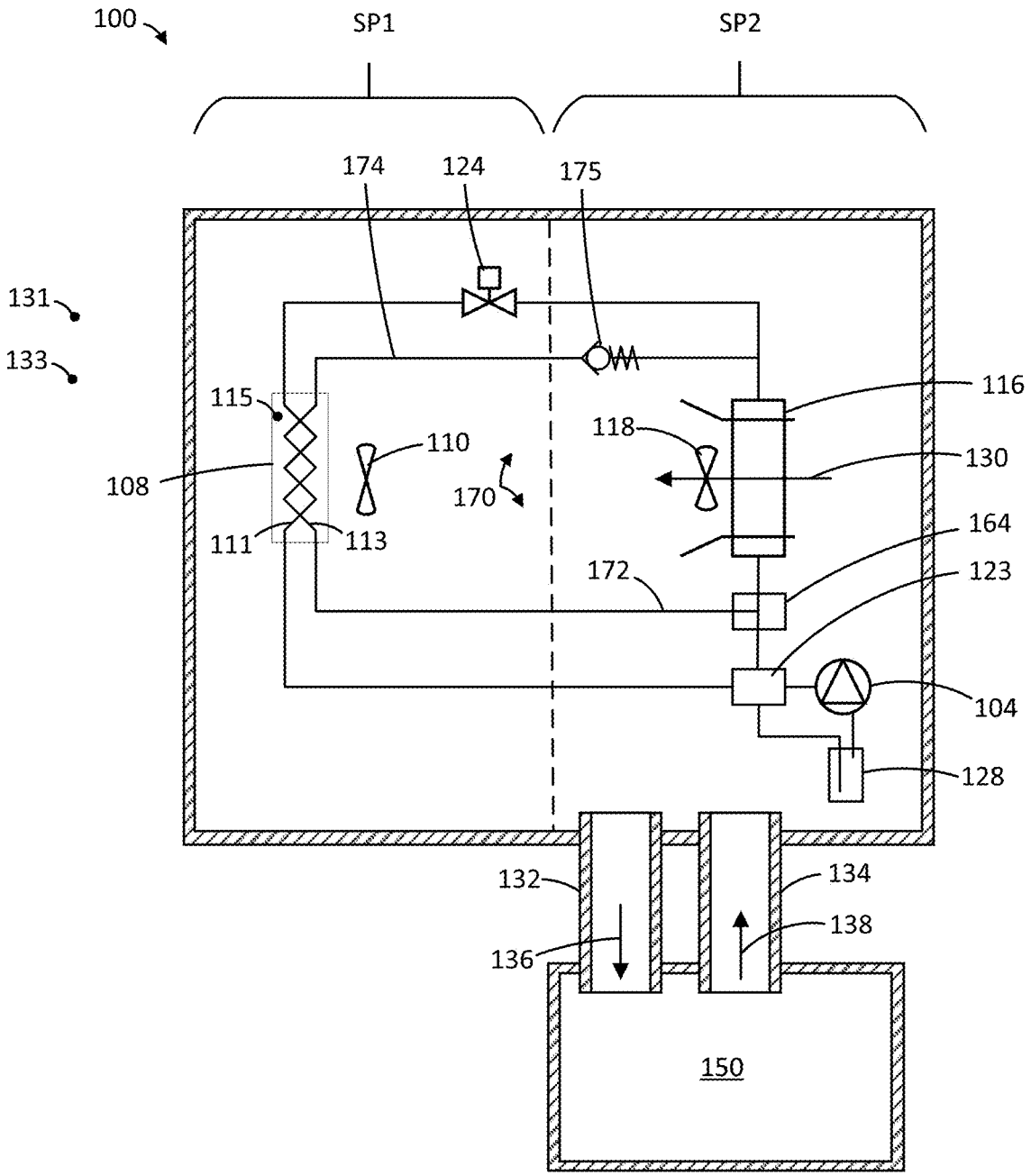
FIG. 1 is a schematic view of a HVAC system connected to an indoor space, according to one or more embodiments.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The present disclosure relates to heat pump heating, ventilating, and air conditioning ("heat pump HVAC", or more simply referred to herein as "HVAC") systems, and more particularly to systems and methods for defrosting the outdoor heat exchanger of HVAC systems. While a HVAC system is discussed, it should also be appreciated that the concepts are applicable to refrigeration systems as well. Additionally, although defrosting is described, it should also be appreciated that systems and methods can also be used to preventing frost or ice formation before accumulation.

Figure 2:
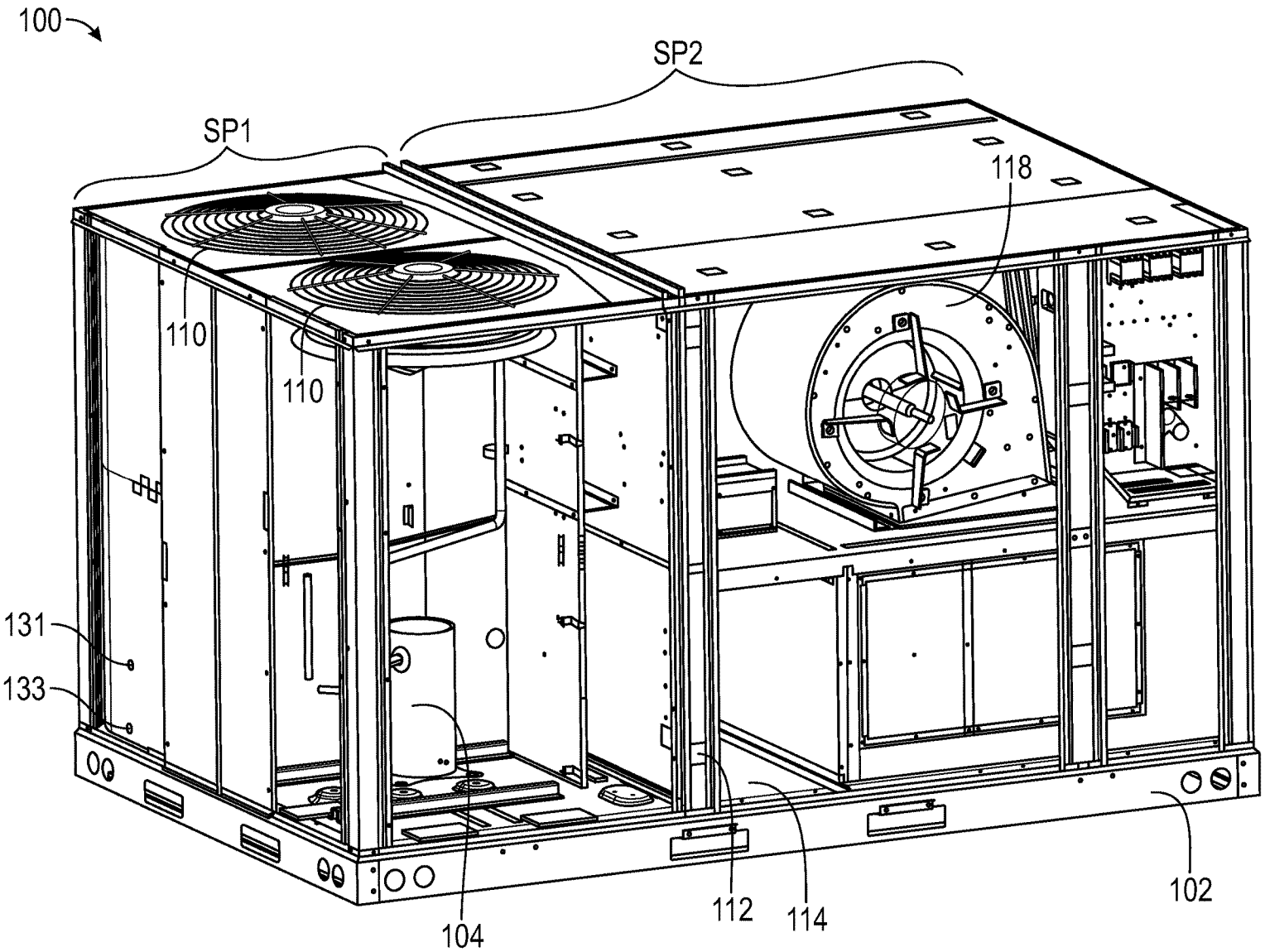
FIG. 2 is a partial isometric view of the HVAC system of FIG. 1.
Figure 3:
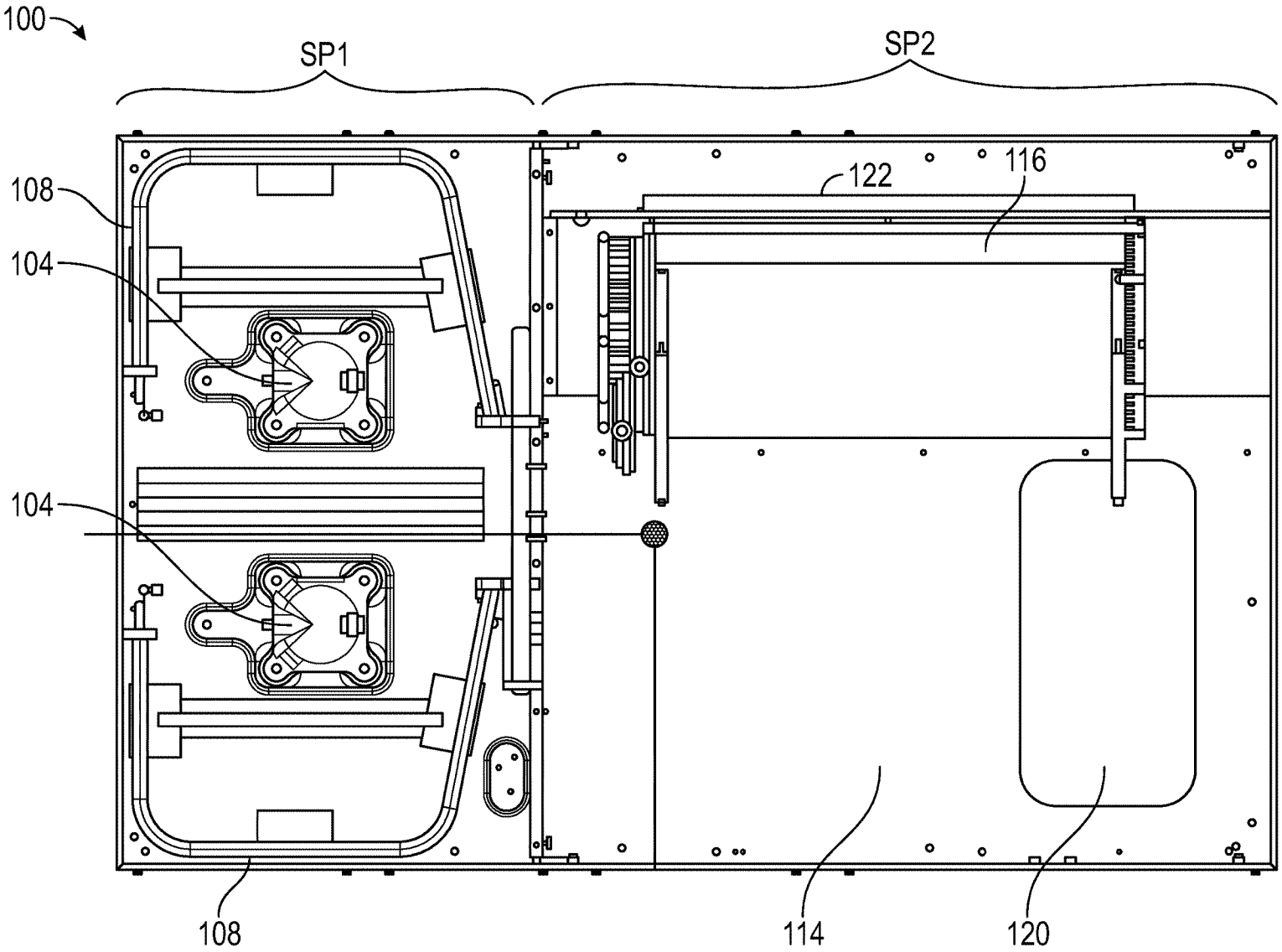
FIG. 3 is sectioned top view of the HVAC system of FIG. 2.

Referring now to FIGS. 1-3, a HVAC system 100 is shown in a schematic, partial isometric, and top view, respectively with some of the components of the HVAC system 100 removed for clarity. Although not shown in each of the drawings, it should be appreciated that the HVAC system 100 in FIGS. 2 and 3 includes additional components such as panel covers for covering and protecting the equipment of the HVAC system 100. The example HVAC system 100 is a so-called "light" commercial packaged rooftop unit, however the HVAC system 100 may also represent residential packaged, residential split, light commercial split, or commercial applied applications as well as refrigeration system applications. The HVAC system 100 may be a variable refrigerant flow system with variable speed outdoor fans 110. The HVAC system 100 includes both an "outdoor" section SP1 and an "indoor" section SP2 mounted on a common frame 102. Further, the HVAC system 100 may be a variable refrigerant flow heat pump system.

The outdoor section SP1 includes one or more compressors 104, which may be any suitable type. (e.g., fixed speed, two speed, variable speed, fixed volume, variable volume, etc.) As noted above, the outdoor section SP1 may include other HVAC system components, such as but not limited to accumulators, receivers, charge compensators, flow control devices, air movers, pumps, and filter driers secured within and attached to the structure of the HVAC system 100. Also included are one or more outdoor heat exchangers 108 and outdoor fans 110 that move air into the outdoor section SP1 across the outdoor heat exchanger 108 and to the outside of the HVAC system 100. FIG. 1 is shown without the additional outdoor heat exchanger 108 and the outdoor fan 110, however, FIG. 2 shows a system with two fans 110, and FIG. 3 shows a system with two outdoor heat exchangers 108. The outdoor fans 110 may be any suitable type of fan, for example, a propeller fan. The outdoor heat exchangers 108 may include a plurality of heat-transfer tubes (e.g., the primary passages 111 of FIGS. 4A-4F), in which a refrigerant flows, and a plurality of heat-transfer fins (not shown), in which air flows between gaps thereof. The plurality of heat-transfer tubes may be arranged in an up-down direction (herein referred to as "row direction"), and each heat-transfer tube may extend in a direction substantially orthogonal to the up-down direction (in a substantially horizontal direction). At an end portion of the outdoor heat exchangers 108, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins that extend, so as to be oriented in the up-down direction, are arranged side by side with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins may also be disposed in a plurality of columns.

Due to the structure of the outdoor heat exchangers 108, operation of the outdoor fans 110 draws a flow of outdoor air into the outdoor section SP1 and passes through the outdoor heat exchangers 108. As the outdoor air passes through the outdoor heat exchanger 108 the outdoor air exchanges thermal energy with the refrigerant that flows in the outdoor heat exchangers 108. After the thermal energy exchange in the outdoor heat exchanger 180, the air is then also discharged to the outside of the outdoor section SP1 by the outdoor fans 110. Even though the heat exchanger 108 is described as a round tube and plate fin heat exchanger, other heat exchanger types, such as for instance a microchannel heat exchanger, are within the scope of the disclosure.

The outdoor section SP1 and the indoor section SP2 are separated by a partition plate 112. Outdoor air flows to the outdoor section SP1 and indoor air flows to the indoor section SP2. By separating the outdoor section SP1 and the indoor section SP2 by the partition plate 112, the airflow bypass between the outdoor section SP1 and the indoor section SP2 is blocked. Therefore, in an ordinary state, the indoor air and the outdoor air do not mix and do not communicate with each other within or via the HVAC system 100. It has to be noted, that there exist the airside economizers that allow mixing indoor and outdoor air, however they are not discussed in relation to this disclosure.

The indoor section SP2 also includes an indoor heat exchanger 116 and an indoor blower 118, which may be, for example, a centrifugal fan. The indoor section SP2 may also optionally include a combustion heat exchanger (not shown). The indoor heat exchanger 116 may also include a plurality of heat-transfer tubes, in which a refrigerant flows, and a plurality of heat-transfer fins, in which air flows between gaps thereof. The plurality of heat-transfer tubes may be arranged in an up-down direction (row direction), and each heat-transfer tube may extend in a direction substantially orthogonal to the up-down direction. At an end portion of the indoor heat exchanger 116, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins and the plurality of heat-transfer tubes may be assembled so that each heat-transfer fin extends through the plurality of heat-transfer tubes. Although the heat exchanger 116 is described as a round tube and plate fin heat exchanger, other heat exchanger types, such as for instance a microchannel heat exchanger, are within the scope of this disclosure.

The indoor heat exchanger 116 divides the indoor section SP2 into a space on an upstream side with respect to the indoor heat exchanger 116 and a space on a downstream side with respect to the indoor heat exchanger 116. All air that flows to the downstream side from the upstream side with respect to the indoor heat exchanger 116, passes through the indoor heat exchanger 116. The indoor blower 118 is disposed in the space on the downstream side with respect to the indoor heat exchanger 116 and causes a blower airflow 130 that passes through the indoor heat exchanger 116 to be generated. As shown in FIG. 1, a supply duct 132 is connected downstream from heat exchanger 116, and a return duct 134 is connected upstream from the heat exchanger 116. In this manner a loop or circuit is formed whereby air passes in a cycle between the indoor heat exchanger 116 and an indoor space 150 by passing from the blower airflow 130, to a supply airflow 136, to the indoor space 150, and to a return airflow 138 that leads back to the indoor heat exchanger 116. Although not specifically shown in FIG. 3, the supply duct 132 may attach to a supply air opening 120, while the return duct 134 may attach to a return air opening 122, each via a bottom plate 114 in the bottom of the HVAC system 100 (note that the side air supply and discharge are also feasible). Alternatively, the horizontal, instead of downward, supply and return air ducts can be provided, and the down-shot air duct configurations are also within the scope of the disclosure. The blower 118 is disposed above the supply air opening 120 in the bottom plate 114 for providing supply air to the indoor space 150 or environment being conditioned.

Referring to FIG. 1, the HVAC system 100 also includes a refrigerant circuit that recirculates a refrigerant between the indoor heat exchanger 116 and the outdoor heat exchangers 108. When in a cooling operation or a heating operation, the refrigerant circuit circulates a refrigerant to perform a vapor compression refrigeration cycle, whereby heat is exchanged at the indoor heat exchanger 116 and at the outdoor heat exchangers 108. The refrigerant circuit includes the compressor 104, the outdoor heat exchanger 108, the indoor heat exchanger 116, a configurable 4-way valve 123, a bi-flow expansion device 124, and an accumulator 128. Optionally, the refrigerant circuit may also include a filter drier.

In a cooling mode, the refrigerant is compressed by the compressor 104 and is sent through the four-way valve 123 to the outdoor heat exchangers 108. The refrigerant dissipates heat to outdoor air at the outdoor heat exchangers 108 and is sent to the bi-flow expansion device 124. At the bi-flow expansion device 124, the refrigerant expands and its pressure and temperature are reduced. The refrigerant then flows to the indoor heat exchanger 116. A refrigerant having a low temperature and a low pressure sent from the bi-flow expansion device 124 exchanges heat at the indoor heat exchanger 116, absorbing heat from indoor air. The air cooled by having its heat taken away at the indoor heat exchanger 116 is supplied to the indoor space 150 or environment being conditioned. The refrigerant after the heat exchange at the indoor heat exchanger 116 is evaporated into a gaseous state and then travels back through the four-way valve 123, to the accumulator 128, and is then sucked back into the compressor 104 to repeat the cycle. Thus, in a cooling mode, the indoor heat exchanger 116 operates as an evaporator. It has to be noted that the bi-flow expansion device 124 can be replaced by two unidirectional expansion devices, one dedicated to a cooling mode of operation and the other to a heating mode of operation.

In a heating mode, the refrigerant is compressed by the compressor 104 and is sent through the four-way valve 123 to the indoor heat exchanger 116. The refrigerant dissipates heat to indoor air at the indoor heat exchanger 116 and is sent to the bi-flow expansion device 124. At the bi-flow expansion device 124, the refrigerant expands and its pressure and temperature are reduced. The refrigerant then flows to the outdoor heat exchangers 108. A refrigerant having a low temperature and a low pressure sent from the bi-flow expansion device 124 exchanges heat at the outdoor heat exchanger 108, absorbing heat from the outdoor air. The refrigerant after the heat exchange at the outdoor heat exchangers 108 is evaporated into a gaseous state and then travels back through the four-way valve 123, to the accumulator 128, and is then sucked back into the compressor 104 to repeat the cycle. Thus, in a heating mode, the outdoor heat exchanger 108 operate as an evaporator. Concurrently with the refrigeration cycle described above, air is also circulated in a cycle between the indoor heat exchanger 116 and the indoor space 150, such that heat from the refrigeration cycle is transferred into the indoor space 150. In particular, the blower airflow 130 is heated by heat exchange with the indoor heat exchanger 116, is supplied via the supply duct 132 and the supply airflow 136 to the indoor space 150 being heated, and the return airflow 138 returns along the return duct 134 to the indoor heat exchanger 116.

Referring still to FIG. 1, the HVAC system 100 further includes a defrost circuit 170 including a three-way valve 164, a defrost line 172, a defrost return line 174, a defrost passages 113 in the outdoor heat exchanger 108, and an optional check valve 175 along the defrost return line 174. Optionally, the defrost circuit 170 may also include a temperature sensor 115 that measures the temperature of the outdoor heat exchanger 108. The three-way valve 164 is positioned between the four-way valve 123 and the indoor heat exchanger 116, and thus the three-way valve 164 is upstream of the indoor heat exchanger 116 when the refrigeration circuit is in the heating mode. When the HVAC system 100 is in the heating and cooling modes, the three-way valve 164 acts as a pass through and thus provides fluid communication between the four-way valve 123 and the indoor heat exchanger 116. Additionally, when the HVAC system 100 is in the defrost mode, the three-way valve 164 is selectably operated to flow some or all of the refrigerant from the compressor 104 through the defrost line 172 and the defrost passage 113 in the outdoor heat exchanger 108. After exiting the outdoor heat exchanger 108, the refrigerant in the defrost passage 113 flows into the defrost return line 174 and rejoins the refrigeration circuit downstream of the indoor heat exchanger 116. The optional check valve 175 allows the refrigerant to flow along the defrost return line 174 from the outdoor heat exchanger 108 while blocking reverse flow of the refrigerant into the outdoor heat exchanger 108. It has to be noted that the three-way valve 164 may be of a modulating type, pulsating type, or ON/OFF type valve.

The equipment of the refrigerant circuit, and thus flow of the refrigerant through the circuit may be controlled by a main controller (e.g., controller 500 of FIG. 8 discussed latter herein) that controls the HVAC system 100. The main controller may also be configured to be capable of communicating with a remote controller. A user can send, for example, a set values of indoor temperatures of rooms in the indoor space 150 being conditioned to the main controller from the remote controller. For controlling the HVAC system 100, a plurality of temperature sensors for measuring the temperature of a refrigerant at each portion of the refrigerant circuit and/or a pressure sensor that measures the pressure of each portion and/or temperature sensors for measuring the air temperatures within the supply ducts 132 and/or the return ducts 134 may be used.

The main controller performs at least on/off control of the compressors 104, on/off control of the outdoor fans 110, and on/off control of the indoor blower 118. In addition, when motors within the system are variable speed motors, (e.g., motor(s) for the compressor(s) 104, the outdoor fan(s) 110, and the indoor blower(s) 118), the controller may be configured to individually control the speed of each motor. In this manner, the rate of heat exchange of the HVAC system 100 may be controlled by controlling the blower 118 motor rotational speed thereby controlling the flow rate of the blower airflow 130 across the indoor heat exchanger 116. Similarly, the rate of heat exchange of the HVAC system 100 may be controlled by controlling the compressor 104 motor thereby controlling the flowrate and or pressures of the refrigerant in the refrigerant circuit.

The main controller may be realized by, for example, a computer. The computer that constitutes the main controller includes a control calculation device and a storage device. For the control calculation device, a processor such as a CPU or a GPU may be used. The control calculation device reads a program that is stored in the storage device and performs a predetermined image processing operation and a computing processing operation in accordance with the program. Further, the control calculation device writes a calculated result to the storage device and reads information stored in the storage device in accordance with the program. However, the main controller may be formed by using an integrated circuit (IC) that can perform control similar to the control that is performed by using a CPU and a memory. Here, IC includes, for example, LSI (large-scale integrated circuit), ASIC (application-specific integrated circuit), a gate array, and FPGA (field programmable gate array).

When the bi-flow expansion device 124 is a TXV, the TXV is controlled using a temperature sensing bulb and an equalizer line (not shown) that may be connected to the refrigerant circuit at a position downstream of the sensing bulb. The temperature sensing bulb may be placed on a compressor suction line upstream from the compressor 104 and downstream of the four-way valve 123, with respect to the refrigerant flow. If the accumulator 128 is used, the bulb may be placed in the compressor suction line upstream or downstream of the accumulator 128, with respect to the refrigerant flow. In this manner, the output of the sensing bulb is adjusted to account for the amount of liquid refrigerant within the accumulator 128. The location of the sensing bulb may be selected to optimize vapor compression refrigeration cycle, depending on user preferences for the HVAC system 100. Additionally, the HVAC system 100 may include an equalization line (not shown) in communication with the pressures in the indoor heat exchanger 116 and the outdoor heat exchanger 108. In cooling mode for example, the indoor heat exchanger 116 is the evaporator and the pressure of the refrigerant leaving the indoor heat exchanger 116 is communicated to the TXV through the equalizer line. Pressure communicated through the equalizer line may be used to balance the pressure communicated to the bi-flow expansion device 124 from the sensing bulb to operate the TXV. The TXV may be set to maintain a compressor superheat while optimizing whichever of the indoor heat exchanger 116 or outdoor heat exchanger 108 is operating as the evaporator. Controlling the TXV with this method allows the evaporator superheat to be maintained at more efficient levels. Further, the bi-flow expansion device 124 may include an internal bleed port to maintain a more accurate and stable control, as well as equalize the high side pressure and low side pressure during the off-cycle. Further, the TXV may also be a so-called balanced port design with the pressure of the refrigerant at the condenser balanced across the valve.

If the accumulator 128 is used in the compressor suction line (e.g., line downstream from the compressor 104), the accumulator 128 allows for the collection of some refrigerant, before the refrigerant flows to the compressor 104. The accumulator 128 provides the benefit of separating some non-vaporized refrigerant before passing to the compressor 104. Further, the bi-flow expansion device 124 is also configurable to control the flow of refrigerant to store some refrigerant in the accumulator 128 if there is a refrigerant charge imbalance in the refrigeration circuit. In doing so, the bi-flow expansion device 124 may be configured to lower a superheat of the evaporator, which in the cooling mode is the indoor heat exchanger 116, compared to not including the accumulator in the HVAC system 100. This allows a lower capacity evaporator to be used for the load of the HVAC system 100. As an example, the bi-flow expansion device 124 is configurable to control flow of the refrigerant through the evaporator such that a superheat of the evaporator is as close to zero as possible while maintaining a superheat control at the compressor 104.

In addition, in some embodiments, the bi-flow expansion device 124 may be an electronic expansion valve ("EXV"), and a pair of temperature or temperature/pressure sensors (not shown) may be connected to a main controller (e.g., controller 500 of FIG. 8 discussed latter herein) to provide measurement data for the control of the EXV bi-flow expansion device 124 operation. The temperature and/or pressure sensors are positioned to sense temperature and/or pressure in the compressor suction line and/or the accumulator 128 upstream of the compressor 104 and downstream of the four-way valve 123. The main controller (e.g., controller 500 of FIG. 8) processes the measurement data and provides control commands to the EXV bi-flow expansion device 124 to operate the HVAC system 100 similarly to the TXV operation discussed above.

Referring still to FIG. 1, when the HVAC system 100 is operating in heating mode, the outdoor heat exchanger 108 is an evaporator that is on the "cold" side of the refrigeration cycle. A cold outdoor heat exchanger 108 operating in a cold environment presents the problem of ice formation on the outdoor heat exchanger 108. During the heating mode, the ice formation may be detected by a controller (e.g., controller 500 of FIG. 8) monitoring the temperature measurement of the temperature sensor 115 on the outdoor heat exchanger 108. Temperatures at or below 0° C. (32° F.) indicate conditions where ice can form, so an initial measurement of 0° C. (32° F.), or a continued measurement of 0° C. (32° F.) may be used to begin the defrost mode of operation. Additionally or alternatively, measurements of the outdoor air temperature and/or the outdoor air humidity may be used to predict conditions where ice can form on the outdoor heat exchanger 108. As discussed further herein, trends of the outdoor air temperature and humidity may be collected by measurements of sensors 131, 133 by the controller 500 and the defrost mode of operation may begin before ice forms on the outdoor heat exchanger 108. To defrost ice on the outdoor heat exchanger 108, the HVAC system 100 may be configured to reverse the refrigeration cycle in a defrost mode, whereby the indoor heat exchanger 116 would be operable as the evaporator, and thus placing the outdoor heat exchanger 108 onto the "hot" side of the refrigeration cycle as a condenser. However, reversing the refrigeration cycle and placing the indoor heat exchange 116 on the "cold side" of the refrigeration cycle is not desirable with regards to the continued need of heating the indoor space 150. In particular, the blower air flow 130 would be cooled as it passes across the indoor heat exchanger 116 and thus the indoor space 150 would also be cooled when operating in the defrost mode. In many cases, an electric heater positioned downstream of the indoor heat exchanger 116 is used to compensate for this cooling load associated with the indoor heat exchanger 116 and provide either a neutral or heated air to the conditioned space. However, an addition of an electric heater presents significant extra power consumption during the defrost cycle, reducing an overall unit efficiency, and higher costs associated with the electric heater itself as well as the space allocation within the unit cabinet to accommodate the electric heater. Therefore, the electric heater addition is not desirable and should be avoided. Thus, to maintain a comfortable temperature for the occupants within the indoor space 150, the refrigeration cycle is not reversed when switching between the heating mode and the defrost mode, so that the indoor heat exchanger 116 remains on the "hot side" of the refrigeration circuit. Additionally, the three-way valve 164 is actuated to flow some or all of the refrigerant from the compressor 104 through the defrost line 172 and the defrost passage 113 in the outdoor heat exchanger 108. Because the refrigerant in the defrost line 172 is a hot compressed refrigerant, heat is exchanged in the outdoor heat exchanger 108 via the defrost passages 113, and any ice on the outdoor heat exchanger 108 is melted. After exiting the outdoor heat exchanger 108, the refrigerant in the defrost passage 113 flows into the defrost return line 174 and rejoins the refrigeration circuit downstream of the indoor heat exchanger 116. Thus, the refrigerant flowing from the defrost return line 174 and the refrigerant flowing through the indoor heat exchanger 116 are combined and flow through the bi-flow expansion device 124, through the outdoor heat exchanger 108, and return to the compressor 104 to repeat the cycle.

During the defrost mode, the indoor blower 118 may continue to operate and pass the blower air flow 130 over the indoor heat exchanger 116. For example, the indoor blower 118 may continue to operate when the warmed and compressed refrigerant continues to flow through the three-way valve 164 and through the indoor heat exchanger 116. Thus, during the defrost mode, the supply air flow 136 can continue to warm the indoor space 150 and maintain a comfortable temperature for the occupants therein. Optionally, the controller (e.g., controller 500 of FIG. 8) can also reduce the rotational rate of the indoor blower 118 to reduce the blower air flow 130. In some operational conditions, the amount of refrigerant diverted through the defrost line 172, which thus bypasses the indoor heat exchanger 116, may reduce the heating rate of the blower airflow 130. So in some operational conditions, a reduced blower air flow 130 may be used to provide the indoor heat exchanger 116 more time to heat the blower air flow 130 and to thus provide a more consistent temperature of the supply airflow 136 into the indoor space 150.

Optionally, if the three-way valve 164 is actuated to flow all of the refrigerant from the compressor 104 through the defrost line 172, the refrigerant may fully bypass the indoor heat exchanger 116. By fully bypassing the indoor heat exchanger 116, no heating would be provided to the indoor space 150, and the controller (e.g., controller 500 of FIG. 8) could again reduce the rotational rate of the indoor blower 118 to reduce the blower air flow 130. Optionally, the indoor blower 118 could also be turned off during the defrost mode.

Additionally, since the refrigerant of the HVAC system 100 does not have to reverse the refrigerant cycle to switch between the heating and defrost modes of operation, the system components such as the compressor 104 and four-way valve 123 will be less stressed mechanically and thermally, provide higher reliability numbers, allow for less stringent restrictions on the operating conditions, and will permit lower maintenance requirements.

Referring to FIGS. 4A-4F, the outdoor heat exchanger 108 is shown in a schematic cross-sectional view to illustrate the heat transfer tubes or channels used for the refrigeration circuit and for the defrost circuit 170. During heating, cooling, and defrost operational modes, the refrigerant circulating in the refrigeration cycle is passed through the primary passages 111. During the defrost mode, the refrigerant in the defrost circuit 170 is passed through the defrost passages 113. Any quantity or arrangement of the primary passages 111 and the defrost passages 113 may be used. Thus, the direction of the refrigerant flow through the passages 111, 113 may be parallel flow, counter flow, or any combination thereof. In the manner previously described above, an end portion of the outdoor heat exchangers 108 may be used to interconnect the primary passages 111. Additionally, the end portion of the outdoor heat exchanger 108 may be used to interconnect the defrost passages 113. For example, U-shaped return bends may direct the flow of refrigerant from a certain defrost passage 113 column to another defrost passage 113 column and/or a row to another row.

Figure 4A:
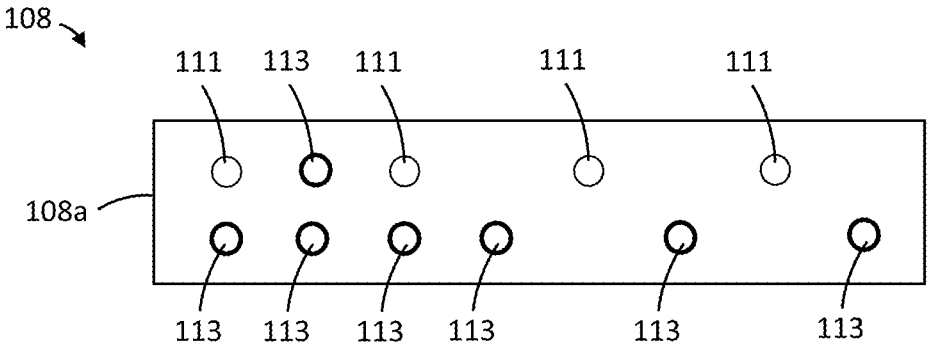
FIGS. 4A-4F are schematic views of outdoor heat exchangers that may be used with the HVAC systems, according to one or more embodiments.

The quantity of the primary passages 111 and the quantity of the defrost passages 113 may be the same or may be different. The spacing between adjacent primary passages 111 may be the same or may be different from the spacing between adjacent defrost passages 113. Additionally, the spacing and quantity of passages 111, 113 may be varied along a length of the outdoor heat exchanger 108. As shown in the example of FIG. 4A, portions of the outdoor heat exchanger 108 that form ice the soonest during operation of the HVAC system 100 (such as along a bottom portion 108*a*) could be configured with more and/or more densely spaced defrost passages 113.

Figure 4B:
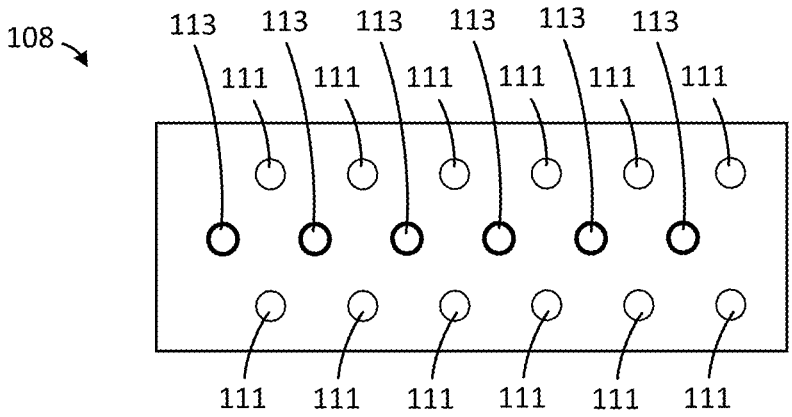

Referring to FIG. 4B an example outdoor heat exchanger 108 is shown with a three row arrangement of the primary passages 111 and the defrost passages 113. A plurality of the primary passages 111 are arranged in two rows along a perimeter of the outdoor heat exchanger 108, while a plurality of the defrost passages 113 are arranged along a central row between the two rows of the primary passages 111.

Figure 4C:
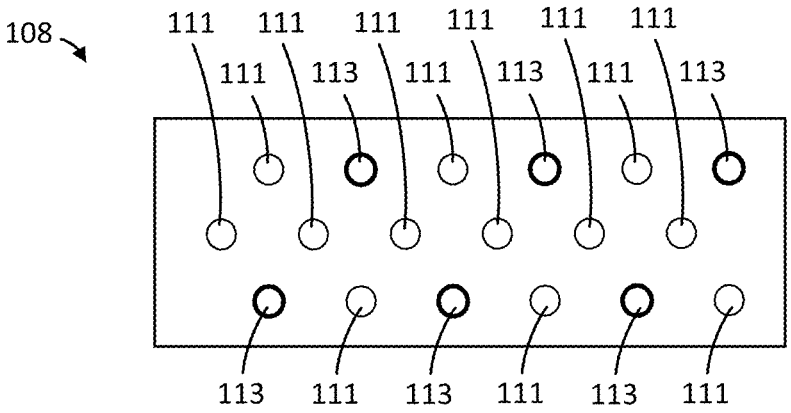

Referring to FIG. 4C another outdoor heat exchanger 108 is shown with a three row arrangement of the primary passages 111 and the defrost passages 113 A plurality of the primary passages 111 are arranged along each of the three rows, and the spacing between adjacent primary passages 111 is increased along the perimeter rows, relative to the spacing between adjacent primary passages 111 of the central row. In addition, the defrost passages 113 are arranged along the two perimeter rows and alternate with the primary passages 111.

Figure 4D:
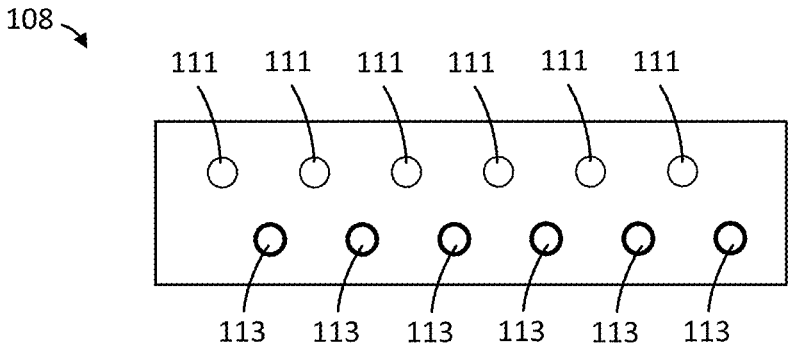

Referring to FIG. 4D another example outdoor heat exchange 108 is shown with a two row arrangement of the primary passages 111 and the defrost passages 113. The primary passages 111 are arranged in one row, while the defrost passages 113 are arranged in a second row that is spaced apart from the first row of the primary passages 111.

Figure 4E:
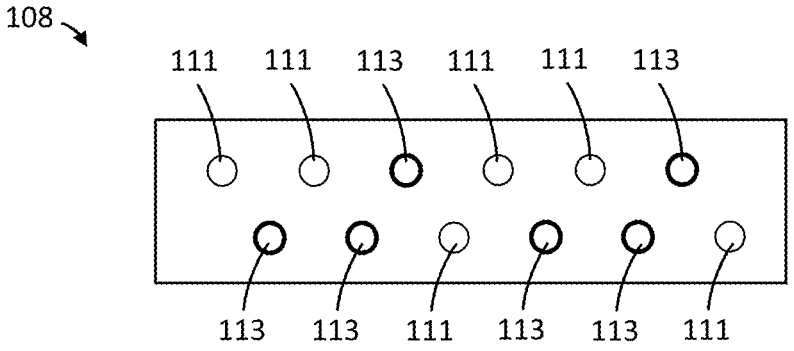

Referring to FIG. 4E another example outdoor heat exchange 108 is shown with a two row arrangement of the primary passages 111 and the defrost passages 113. In a first row, there are twice as many primary passages 111 as defrost passages 113 and the arrangement alternates with one defrost passage 113 between two primary passages 111. Additionally, in the second row, there are twice as many defrost passages 113 as primary passages 111, and the arrangement alternates with one primary passage 111 between two defrost passages 113.

Figure 4F:
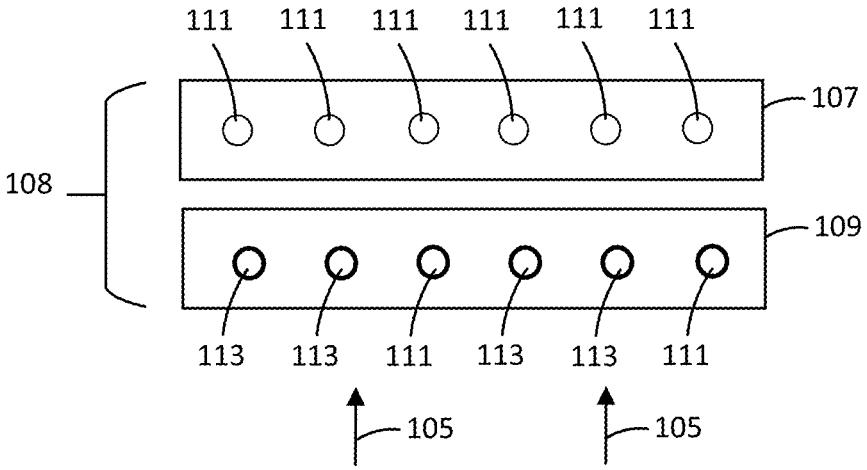

Optionally, as shown in a schematic cross-sectional view of FIG. 4F, the outdoor heat exchanger 108 may comprise a primary slab 107 including the primary passages 111 and a defrost slab 109 including the defrost passages 113. The primary slab 107 is shown spaced apart from the defrost slab 109, however, it is also contemplated that the primary slab 107 may physically contact the defrost slab 109 and allow conductive heat transfer therebetween. In the example of FIG. 4F, the defrost slab 109 is upstream from the primary slab 107 relative to the direction of an outdoor airflow 105. During the defrost operation mode, the defrost slab 109 is used to heat the outdoor air 105, prior to the outdoor air 105 passing over the primary slab 107. In this manner, convective heat transfer may be used to transfer heat energy from the defrost passages 113 and defrost the outdoor heat exchanger 108. Furthermore, the defrost slab 109 and primary slab 107 can be interlaced or intertwined for optimal heat flux distribution and more efficient defrost operation.

Figure 5:
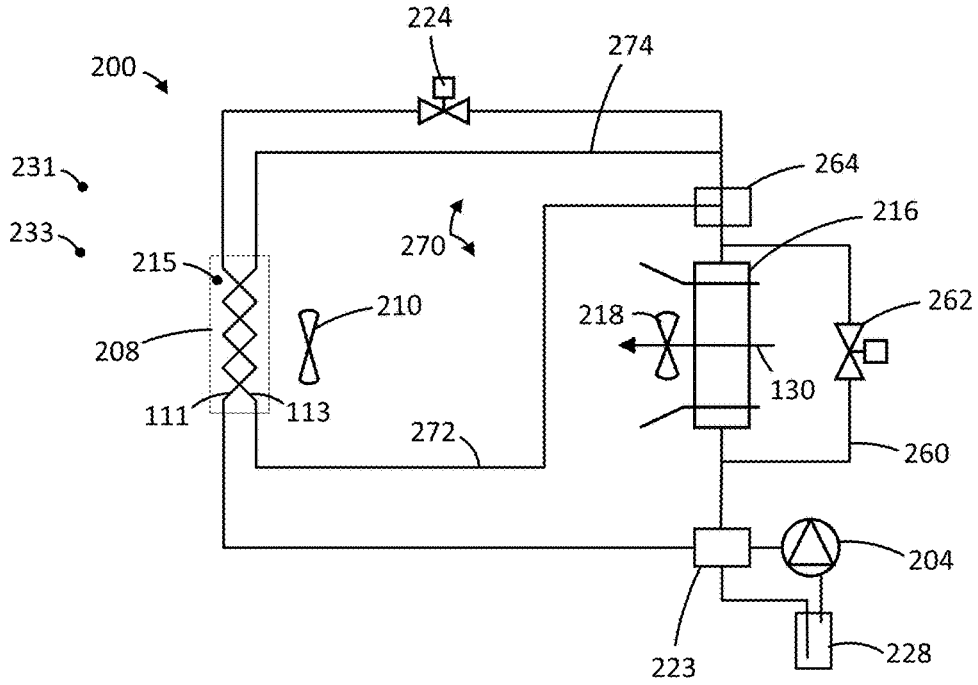
FIG. 5 is a schematic view of another HVAC system, according to one or more embodiments.

Referring to FIG. 5, another embodiment of an HVAC system 200 is shown. Generally speaking, some of the components and refrigeration circuit of the HVAC system 200 are similar to the components and refrigerant circuit of the HVAC system 100, and thus the same or similar reference numerals are used. In addition, the operational description is not repeated in the interest of brevity, but instead will focus on features of the HVAC system 200 that are different from the HVAC system 100. In particular, the refrigeration circuit of the HVAC system 200 comprises a compressor 204, a four-way valve 223, an outdoor heat exchanger 208, a bi-flow expansion device 224, an indoor heat exchanger 216, and an accumulator 228, each connected as a refrigeration circuit as described previously for the HVAC system 100. In addition, the HVAC system 200 further includes a defrost circuit 270 having a three-way valve 264, a defrost line 272, a defrost return line 274, and the defrost passages 113 in the outdoor heat exchanger 208. Optionally, the defrost circuit 270 may also include a temperature sensor 215 that measures the temperature of the outdoor heat exchanger 208. The three-way valve 264 is positioned between the indoor heat exchanger 216 and the bi-flow expansion device 224, and thus the three-way valve 264 is downstream of the indoor heat exchanger 216 when the refrigeration circuit is in the heating mode. When the HVAC system 200 is in the heating and cooling modes, the three-way valve 264 acts as a pass through and thus provides fluid communication between the indoor heat exchanger 216 and the bi-flow expansion device 224. Additionally, when the HVAC system 200 is in the defrost mode, the three-way valve 264 is selectably operated to flow some or all of the refrigerant from the indoor heat exchanger 216 through the defrost line 272 and the defrost passage 113 in the outdoor heat exchanger 208. After exiting the outdoor heat exchanger 208, the refrigerant in the defrost passage 113 flows into the defrost return line 274 and rejoins the refrigeration circuit downstream of the indoor heat exchanger 216 and the three-way valve 264.

Optionally, the HVAC system 200 further comprises a bypass line 260 and a bypass valve 262. The bypass valve 262 is selectably operated to flow some or all of the refrigerant from the compressor 204 to a position downstream of the indoor heat exchanger 216, when the HVAC system 200 is in a defrost mode.

Referring still to FIG. 5, when the HVAC system 200 is operating in heating mode, the outdoor heat exchanger 208 is an evaporator that is on the "cold" side of the refrigeration cycle. However, a cold outdoor heat exchanger 208 operating in a cold environment presents the problem of ice formation on the outdoor heat exchanger 208. During the heating mode, the ice formation may be detected by a controller (e.g., controller 500 of FIG. 8) monitoring the temperature measurement of the temperature sensor 215 on the outdoor heat exchanger 208. Temperatures at or below 0° C. (32° F.) indicate conditions where ice can form, so an initial measurement of 0° C. (32° F.), or a continued measurement of 0° C. (32° F.) may be used to begin the defrost mode of operation. Additionally or alternatively, measurements of the outdoor air temperature and/or the outdoor air humidity may be used to predict conditions where ice can form on the outdoor heat exchanger 208. As discussed further herein, trends of the outdoor air temperature and humidity may be collected by measurements of sensors 231, 233 by the controller 500 and the defrost mode of operation may begin before ice forms on the outdoor heat exchanger 208. To defrost ice on the outdoor heat exchanger 208, the HVAC system 200 may be configured to reverse the refrigeration cycle in a defrost mode, whereby the indoor heat exchanger 216 would be operable as the evaporator, and thus placing the outdoor heat exchanger 208 onto the "hot" side of the refrigeration cycle as a condenser. However, reversing the refrigeration cycle and placing the indoor heat exchange 216 on the "cold side" of the refrigeration cycle is not desirable with regards to the continued need of heating the indoor space 150. (FIG. 1) In particular, the blower air flow 130 would be cooled as it passes across the indoor heat exchanger 216 and thus the indoor space 150 would also be cooled when operating in the defrost mode. Thus, to maintain a comfortable temperature for the occupants within the indoor space 150, the refrigeration cycle is not reversed when switching between the heating mode and the defrost mode, so that the indoor heat exchanger 216 remains on the "hot side" of the refrigeration circuit. Additionally, the three-way valve 264 is actuated to flow some or all of the refrigerant from the indoor heat exchanger 216 through the defrost line 272 and the defrost passage 113 in the outdoor heat exchanger 208. However, not all of the heating capacity of the refrigerant is available within the defrost circuit 270 because the warm and compressed refrigerant from the compressor 204 has already exchanged heat with the blower air flow 130 that passes across the indoor heat exchanger 216. Despite having less heating capacity, the refrigerant in the defrost line 272 is warmed and compressed refrigerant, heat is exchanged in the outdoor heat exchanger 208 via the defrost passages 113, and any ice on the outdoor heat exchanger 208 is melted. After exiting the outdoor heat exchanger 208, the refrigerant in the defrost passage 113 flows into the defrost return line 274 and rejoins the refrigeration circuit downstream of the three-way valve 264. Thus the refrigerant flowing from the defrost return line 274 and the refrigerant flowing through the three-way valve 264 are combined and flow through the bi-flow expansion device 224, through the outdoor heat exchanger 208 via the primary passages 111, and return to the compressor 204 to repeat the cycle.

Optionally, when the heating capacity of the refrigerant in the defrost circuit 270 is too low to effectively defrost (e.g., won't defrost, or excessive time to defrost) the outdoor heat exchanger 208, the bypass valve 262 can be used to bypass some or all of the refrigerant flow around the indoor heat exchanger 216.

During the defrost mode, the indoor blower 218 may continue to operate and pass the blower air flow 130 over the indoor heat exchanger 216. For example, the indoor blower 218 may continue to operate when the warmed and compressed refrigerant continues to flow through the three-way valve 264 and through the indoor heat exchanger 216. Thus, during the defrost mode, the supply air flow 136 can continue to warm the indoor space 150 (FIG. 1) and maintain a comfortable temperature for the occupants therein. Optionally, the controller (e.g., controller 500 of FIG. 8) can also reduce the rotational rate of the indoor blower 218 to reduce the blower air flow 130. In some operational conditions, the amount of refrigerant diverted through the bypass valve 262, which thus bypasses the indoor heat exchanger 216, may reduce the heating rate of the blower airflow 130. So in some operational conditions, a reduced blower air flow 130 may be used to provide the indoor heat exchanger 216 more time to heat the blower air flow 130 and to thus provide a more consistent temperature of the supply airflow 136 into the indoor space 150 (FIG. 1).

Optionally, if the bypass valve 262 is actuated to flow all of the refrigerant from the compressor 204 through the bypass line 260 and to the defrost circuit 270, then the refrigerant may fully bypass the indoor heat exchanger 216. By fully bypassing the indoor heat exchanger 216, no heating would be provided to the indoor space 150, and the controller (e.g., controller 500 of FIG. 8) could again reduce the rotational rate of the indoor blower 218 to reduce the blower air flow 130. Optionally, the indoor blower 218 could also be turned off during the defrost mode.

Figure 6:
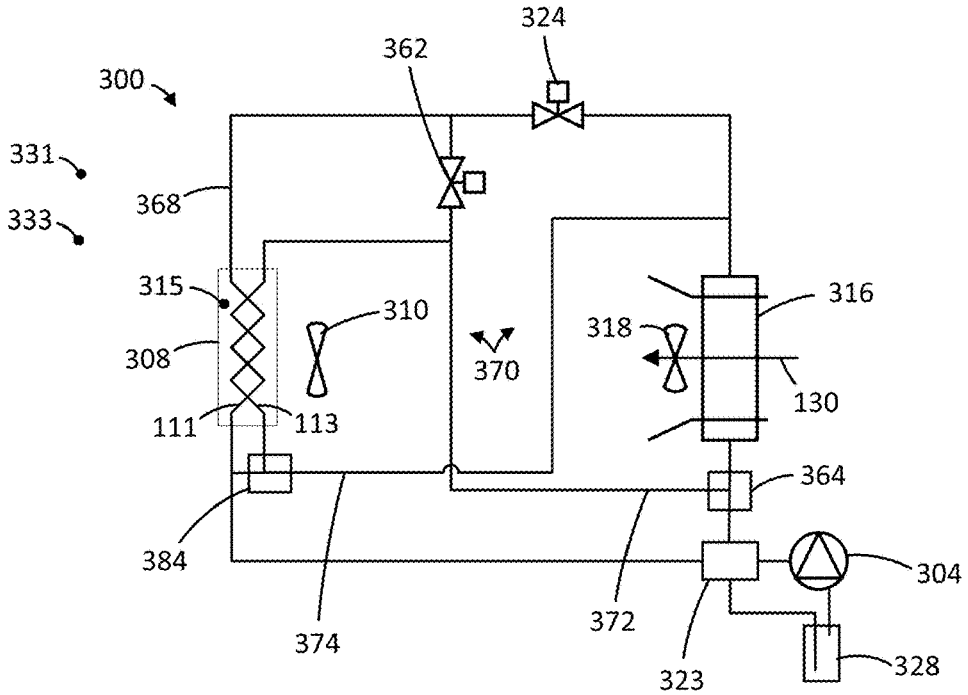
FIG. 6 is a schematic view of another HVAC system, according to one or more embodiments.

Referring now to FIG. 6, another embodiment of an HVAC system 300 is shown. Generally speaking, some of the components and refrigeration circuit of the HVAC system 300 are similar to the components and refrigerant circuit of the HVAC system 100, and thus the same or similar reference numerals are used. In addition, the operational description is not repeated in the interest of brevity, but instead will focus on features of the HVAC system 300 that are different from the HVAC system 100. As described further below, the HVAC systems 100, 300 operate similarly when in defrost mode, but differs with regards to the heating and cooling modes. More specifically in the heating and cooling modes, the HVAC system 300 may be configured to use all of the primary passages 111 and the defrost passages 113 together, thus maximizing the heat transfer effectiveness of the outdoor heat exchanger 308.

The refrigeration circuit of the HVAC system 300 comprises a compressor 304, a four-way valve 323, an outdoor heat exchanger 308, a bi-flow expansion device 324, an indoor heat exchanger 316, and an accumulator 328, each connected as a refrigeration circuit as described previously for the HVAC system 100. In addition, the HVAC system 300 further includes a defrost circuit 370 having a first three-way valve 364, a defrost line 372, a defrost return line 374, the defrost passages 113 in the outdoor heat exchanger 308, a valve 362, and a second three-way valve 384. Optionally, the defrost circuit 370 may also include a temperature sensor 315 that measures the temperature of the outdoor heat exchanger 108. The three-way valve 364 is positioned between the four-way valve 323 and the indoor heat exchanger 316, and thus the three-way valve 364 is upstream of the indoor heat exchanger 316 when the refrigeration circuit is in the heating mode. When the HVAC system 300 is in the heating and cooling modes, the three-way valve 364 acts as a pass through and thus provides fluid communication between the four-way valve 323 and the indoor heat exchanger 316. Additionally, when the HVAC system 300 is in the defrost mode, the three-way valve 364 is selectably operated to flow some or all of the refrigerant from the compressor 304 through the defrost line 372 and the defrost passage 113 in the outdoor heat exchanger 308. After exiting the outdoor heat exchanger 308, the refrigerant in the defrost passage 113 flows into the defrost return line 374 via the second three-way valve 384 and rejoins the refrigeration circuit downstream of the indoor heat exchanger 316. In the defrost mode, the second three-way valve 384 is actuated to provide fluid communication between the defrost passages 113 and the defrost return line 374, while blocking fluid communication therethrough from the primary passages 111. In the heating and cooling modes, the second three-way valve 384 is actuated to provide fluid communication between the primary passages 111 and the defrost passages 113, while blocking fluid communication therethrough to the defrost return line 374.

A refrigerant line 368 extends between the bi-flow expansion device 324 and the primary passage 111 of the outdoor heat exchanger 308. The valve 362 is connected between the defrost line 372 and the refrigerant line 368 and thus selectably provides fluid communication between the primary passage 111 and the defrost passage 113. In particular, the valve 362 is actuated in the heating and cooling modes to provide fluid communication between the primary passages 111 and the defrost passages 113 so that both the primary passage 111 and the defrost passage 113 are operable to use the refrigerant to heat or cool the indoor space 150 (FIG. 1). Additionally, in the defrost mode, the valve 362 is actuated to block flow between the defrost line 372 and the refrigerant line 368. Thus in the defrost mode, the primary passage 111 is not in fluid communication with the defrost passage 113.

Referring still to FIG. 6, when the HVAC system 300 is operating in heating mode, the outdoor heat exchanger 308 is an evaporator that is on the "cold" side of the refrigeration cycle. However, a cold outdoor heat exchanger 308 operating in a cold environment presents the problem of ice formation on the outdoor heat exchanger 308. During the heating mode, the ice formation may be detected by a controller (e.g., controller 500 of FIG. 8) monitoring the temperature measurement of the temperature sensor 315 on the outdoor heat exchanger 308. Temperatures at or below 0° C. (32° F.) indicate conditions where ice can form, so an initial measurement of 0° C. (32° F.), or a continued measurement of 0° C. (32° F.) may be used to begin the defrost mode of operation. Additionally or alternatively, measurements of the outdoor air temperature and/or the outdoor air humidity may be used to predict conditions where ice can form on the outdoor heat exchanger 308. As discussed further herein, trends of the outdoor air temperature and humidity may be collected by measurements of sensors 331, 333 by the controller 500 and the defrost mode of operation may begin before ice forms on the outdoor heat exchanger 308. To defrost ice on the outdoor heat exchanger 308, the HVAC system 300 may be configured to reverse the refrigeration cycle in a defrost mode, whereby the indoor heat exchanger 316 would be operable as the evaporator, and thus placing the outdoor heat exchanger 308 onto the "hot" side of the refrigeration cycle as a condenser. However, reversing the refrigeration cycle and placing the indoor heat exchange 316 on the "cold side" of the refrigeration cycle is not desirable with regards to the continued need of heating the indoor space 150. (FIG. 1) In particular, the blower air flow 130 would be cooled as it passes across the indoor heat exchanger 316 and thus the indoor space 150 would also be cooled when operating in the defrost mode. Thus, to maintain a comfortable temperature for the occupants within the indoor space 150, the refrigeration cycle is not reversed when switching between the heating mode and the defrost mode, so that the indoor heat exchanger 316 remains on the "hot side" of the refrigeration circuit. Additionally, the three-way valve 364 is actuated to flow some or all of the refrigerant from the compressor 304 through the defrost line 372 and the defrost passage 113 in the outdoor heat exchanger 308. In the defrost mode, the valve 362 may be closed or partially open if at least some of the hot gas bypass refrigerant flow is beneficial to maintain a more efficient defrost operation. Because the refrigerant in the defrost line 372 is hot compressed refrigerant, heat is exchanged in the outdoor heat exchanger 308 via the defrost passages 113, and any ice on the outdoor heat exchanger 308 is melted. In addition, when the valve 362 is partially open in the defrost mode, the total flow of the diverted refrigerant flow in the defrost line 372 is split between the primary passages 111 and the defrost passages 113 of the outdoor heat exchanger 308. In particular, when the valve 362 is partially open in the defrost mode, a first portion of the diverted refrigerant flow in the defrost line 372 is flowed through the defrost passages 113 while a second portion of the diverted refrigerant flow in the defrost line 372 is flowed through the primary passages 111. The hot compressed refrigerant of the defrost line 372 is thus added to the primary passages 111 of the outdoor heat exchanger 308 at a position that is downstream from the bi-flow expansion device 324. Therefore, the partial opening of the valve 362 may further defrost any ice on the outdoor heat exchanger 308. After exiting the outdoor heat exchanger 308, the refrigerant in the defrost passage 113 flows into the defrost return line 374, via the second three-way valve 384, and rejoins the refrigeration circuit downstream of the indoor heat exchanger 316. Thus the refrigerant flowing from the defrost return line 374 and the refrigerant flowing through the indoor heat exchanger 316 are combined and flow through the bi-flow expansion device 324, through the primary passage 111 of the outdoor heat exchanger 308, and return to the compressor 304 to repeat the cycle.

When the HVAC system 300 is operating in the heating or the cooling mode, fluid communication is provided between the primary passages 111 and the defrost passages 113, so that the heat transfer effectiveness of the outdoor heat exchanger 308 is maximized. The fluid communication is provided both upstream and downstream of the outdoor heat exchanger 308. In particular, the first three-way valve 364 is actuated to pass all of the refrigerant between the four-way valve 323 and the indoor heat exchanger 316 and to block refrigerant flow into the defrost line 372. Additionally, the valve 362 is opened to provide fluid communication between the primary passage 111 and the defrost passage 113. Additionally, in the heating and cooling modes, the second three-way valve 384 is actuated to provide fluid communication between the primary passages 111 and the defrost passages 113, while blocking fluid communication therethrough to the defrost return line 374.

Referring still to FIG. 6, during the defrost mode, the indoor blower 318 may continue to operate and pass the blower air flow 130 over the indoor heat exchanger 316. For example, the indoor blower 318 may continue to operate when the hot compressed refrigerant continues to flow through the three-way valve 364 and through the indoor heat exchanger 316. Thus, during the defrost mode, the supply air flow 136 can continue to warm the indoor space 150 (FIG. 1) and maintain a comfortable temperature for the occupants therein. Optionally, the controller (e.g., controller 500 of FIG. 8) can also reduce the rotational rate of the indoor blower 318 to reduce the blower air flow 130. In some operational conditions, the amount of refrigerant diverted through the defrost line 372, which thus bypasses the indoor heat exchanger 316, may reduce the heating rate of the blower airflow 130. So in some operational conditions, a reduced blower air flow 130 may be used to provide the indoor heat exchanger 316 more time to heat the blower air flow 130 and to thus provide a more consistent temperature of the supply airflow 136 into the indoor space 150. (FIG. 1)

Optionally, if the three-way valve 364 is actuated to flow all of the refrigerant from the compressor 304 through the defrost line 372, the refrigerant may fully bypass the indoor heat exchanger 316. By fully bypassing the indoor heat exchanger 316, no heating would be provided to the indoor space 150, and the controller (e.g., controller 500 of FIG. 8) could again reduce the rotational rate of the indoor blower 318 to reduce the blower air flow 130. Optionally, the indoor blower 318 could also be turned off during the defrost mode.

Figure 7:
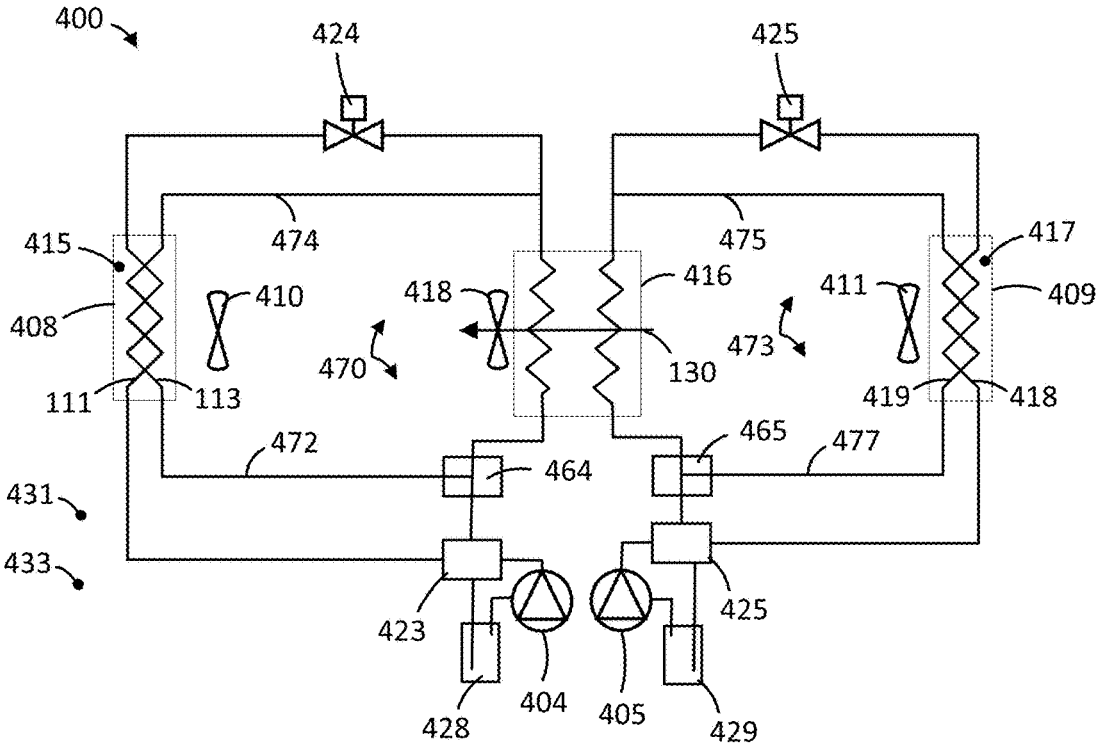
FIG. 7 is a schematic view of a multi-circuit HVAC system, according to one or more embodiments.

Referring to FIG. 7, another embodiment of an HVAC system 400 is shown. Generally speaking, some of the components and refrigeration circuit of the HVAC system 400 are similar to the components and refrigerant circuit of the HVAC system 100, and thus the same or similar reference numerals are used. In addition, the operational description is not repeated in the interest of brevity, but instead will focus on features of the HVAC system 400 that are different from the HVAC system 100. In particular, the HVAC system 400 is a multi-circuit HVAC system that comprises two refrigerant circuits that are fluidly isolated from each other. Generally speaking, each refrigerant circuit circulates a refrigerant to perform a vapor compression refrigeration cycle, whereby heat is exchanged at an indoor heat exchanger and at an outdoor heat exchanger.

In particular, the first refrigerant circuit includes a compressor 404, a first four-way valve 423, a first outdoor heat exchanger 408, a first bi-flow expansion device 424, an indoor heat exchanger 416, and a first accumulator 428, each connected as a first refrigeration circuit as described previously for the HVAC system 100. Similarly, the second refrigerant circuit includes a second compressor 405, a second four-way valve 425, a second outdoor heat exchanger 409, a second bi-flow expansion device 425, the indoor heat exchanger 416, and a second accumulator 429, each connected as a second refrigeration circuit.

As noted by the common reference numeral, the indoor heat exchanger 416 may be shared between the first and second refrigeration circuits, while still maintaining fluid isolation therebetween by having the refrigerants flow through separate tubes within the indoor heat exchanger 416. Similarly, the outdoor heat exchangers 408, 409 can also be combined into a single heat exchanger (e.g., "thermally connected") or could be distributed into more than two heat exchangers.

The HVAC system 400 further includes a first defrost circuit 470 for the first refrigerant circuit and a second defrost circuit 473 for the second refrigerant circuit. The defrost circuits 470, 473 are each configured the same as the defrost circuit 170 of the HVAC system 100. However, the defrost circuits 470, 473 may optionally also include any combination of defrost circuits previously described for HVAC systems 100-300. Optionally, one of the defrost circuits 470, 473 may be omitted when the outdoor heat exchangers 408, 409 are combined into a single heat exchanger or are otherwise thermally connected. Therefore, a defrost circuit 470 for instance, may perform a defrost function for both refrigerant circuits 401, 403.

The first defrost circuit 470 includes a first three-way valve 464 positioned between the first four-way valve 423 and the first indoor heat exchanger 416, and thus the first three-way valve 464 is upstream of the indoor heat exchanger 416 when the first refrigerant circuit is in a heating mode. The first defrost circuit 470 also includes a defrost line 472, the defrost passages 113 extending through the first outdoor heat exchanger 408, and a defrost return line 474. Optionally, the first defrost circuit 470 may also include a temperature sensor 415 that measures the temperature of the first outdoor heat exchanger 408. Similarly, the second defrost circuit 473 includes a second three-way valve 465 positioned between the second four-way valve 425 and the second indoor heat exchanger 416, and thus the second three-way valve 465 is upstream of the second indoor heat exchanger 416 when the second refrigerant circuit is in a heating mode. The second defrost circuit 470 also includes a second defrost line 477, a defrost passages 419 extending through the second outdoor heat exchanger 409, and a second defrost return line 475. Optionally, the second defrost circuit 473 may also include a temperature sensor 417 that measures the temperature of the second outdoor heat exchanger 409.

Referring still to FIG. 7, when the first or the second refrigerant circuit of the HVAC system 400 is operating in heating mode, the outdoor heat exchangers 408, 409 are an evaporator that is on the "cold" side of the refrigeration cycle. However, cold outdoor heat exchangers 408, 409 operating in a cold environment presents the problem of ice formation on the outdoor heat exchangers 408, 409. During the heating mode, the ice formation may be detected by a controller (e.g., controller 500 of FIG. 8) monitoring the temperature measurement of at least one of the temperature sensors 415, 417 on the outdoor heat exchangers 408, 409. Temperatures at or below 0° C. (32° F.) indicate conditions where ice can form, so an initial measurement of 0° C. (32° F.), or a continued measurement of 0° C. (32° F.) may be used to begin the defrost mode of operation. Additionally or alternatively, measurements of the outdoor air temperature and/or the outdoor air humidity may be used to predict conditions where ice can form on the outdoor heat exchangers 408, 409. As discussed further herein, trends of the outdoor air temperature and humidity may be collected by measurements of sensors 431, 433 by the controller 500 and the defrost mode of operation may begin before ice forms on the outdoor heat exchanger 408, 409. To defrost ice on the outdoor heat exchangers 408, 409, the HVAC system 400 may be configured to reverse the refrigeration cycle in a defrost mode, whereby the indoor heat exchanger 416 would be operable as the evaporator, and thus placing the outdoor heat exchangers 408, 409 onto the "hot" side of the refrigeration cycle as a condenser. However, reversing the refrigeration cycle and placing the indoor heat exchange 416 on the "cold side" of the refrigeration cycle is not desirable with regards to the continued need of heating the indoor space 150. In particular, the blower air flow 130 would be cooled as it passes across the indoor heat exchanger 416 and thus the indoor space 150 would also be cooled when operating in the defrost mode. Thus, to maintain a comfortable temperature for the occupants within the indoor space 150, the refrigeration cycle is not reversed, for the first or the second refrigeration circuit, when switching between the heating mode and the defrost mode, so that the indoor heat exchanger 416 remains on the "hot side" of the refrigeration circuit.

In the manner previously described for the defrost circuit 170 of the HVAC system 100, the defrost circuits 470, 473 may circulate hot compressed refrigerant through the outdoor heat exchangers 408, 409 to melt any ice thereon. In particular, the first defrost circuit 470 may circulate refrigerant from the first refrigerant circuit though the first outdoor heat exchanger 408 via the defrost passages 113. Similarly, the second defrost circuit 473 may circulate refrigerant from the second refrigerant circuit though the second outdoor heat exchanger 409 via the defrost passages 419.

Alternatively, the outdoor heat exchangers 408, 409 may also be thermally connected (e.g., combined into one heat exchanger, mechanically touching, etc.) such that only one of the defrost circuits 470, 473 operates to defrost both the outdoor heat exchangers 408, 409. When the outdoor heat exchangers 408, 409 are thermally connected, one of the temperature sensors 415, 417 may be omitted.

During the defrost mode, the indoor blower 418 may continue to operate and pass the blower air flow 130 over the indoor heat exchanger 416, that may remain warm for many different reason. For example, if only one of the defrost circuits 470, 473 is engaged the other refrigeration circuit will continue to heat the indoor heat exchanger 416, which is shared between the circuits in the example of FIG. 7. Additionally, as previously described for the HVAC system 100, the three-way valves 464, 465 may also continue to flow refrigerant through the indoor heat exchanger 416 in the defrost mode, thus again adding heat to the indoor heat exchanger 416. Accordingly, during the defrost mode, the supply air flow 136 can continue to warm the indoor space 150 and maintain a comfortable temperature for the occupants therein. Optionally, the controller (e.g., controller 500 of FIG. 8) can also reduce the rotational rate of the indoor blower 418 to reduce the blower air flow 130, and may also turn off the indoor blower 418.

Figure 8:
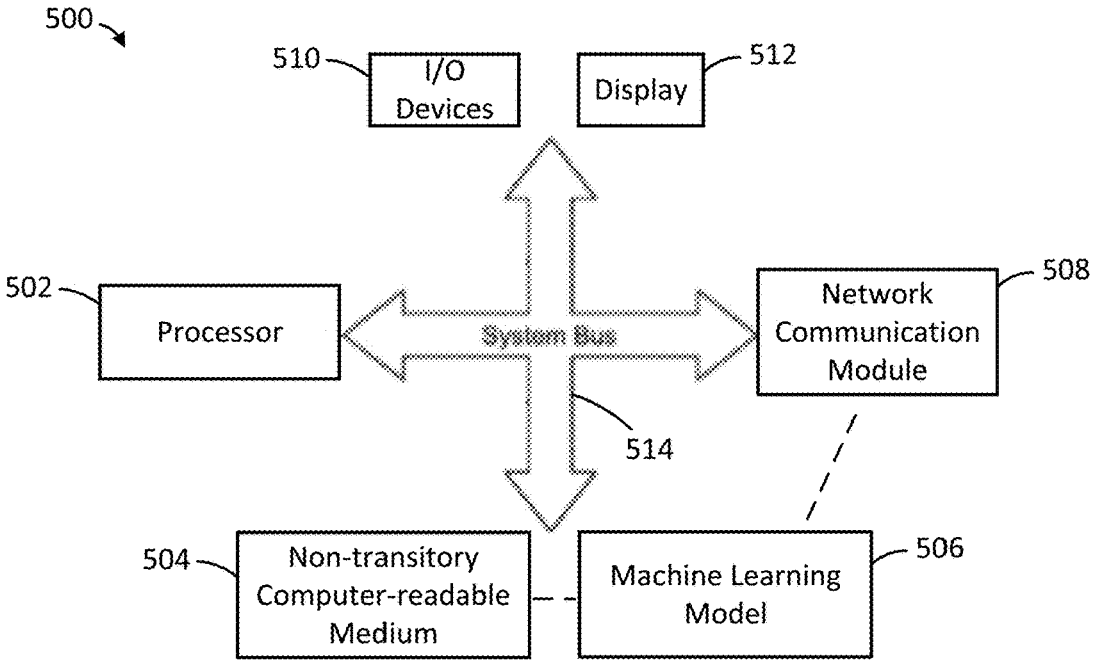
FIG. 8 is a block diagram of a controller, according to one or more embodiments.

Referring to FIG. 8, a block diagram of a controller 500 that can be used to control the blower(s), compressor(s), and valve(s) of an HVAC system, such as in the control systems described above for HVAC systems 100-400. The controller 500 includes at least one processor 502, a non-transitory computer readable medium 504, an optional machine learning model 506, an optional network communication module 508, an optional input/output devices 508, a data storage drive or device, and an optional display 512 all interconnected via a system bus 514. In at least one embodiment, the input/output device 510 and the display 512 may be combined into a single device, such as a touch-screen display. Software instructions executable by the processor 502 for implementing software instructions stored within the controller 500 in accordance with the illustrative embodiments described herein, may be stored in the non-transitory computer readable medium 504 or some other non-transitory computer-readable medium.

Although not explicitly shown in FIG. 8, it should be recognized that the controller 500 may be connected to one or more public and/or private networks via appropriate network connections. It will also be recognized that software instructions may also be loaded into the non-transitory computer readable medium 504 from an appropriate storage media or via wired or wireless means.

During the heating mode, the ice formation may be detected by the controller 500 monitoring the temperature measurement of temperature sensors 115, 215, 315, 415, 417 on the outdoor heat exchangers 108, 208, 308, 408, 409. Temperatures at or below 0° C. (32° F.) indicate conditions where ice can form, so an initial measurement of 0° C. (32° F.), or a continued measurement of 0° C. (32° F.) may be used to begin the defrost mode of operation.

Additionally or alternatively, the controller 500 may be configured to collect measurements of the outdoor air temperature and/or the outdoor air humidity (e.g., by sensors 131, 133, 231, 233, 331, 333, 431, 433) and to analyze historical conditions where ice can form for use with the machine learning model 506. The temperature of the outdoor heat exchangers 108, 208, 308, 408, 409, and thus the instances of ice formation, are dependent on the operating conditions (e.g., usage demand) of the HVAC systems 100, 200, 300, 400, which the machine learning model 506 may use as an input to control the HVAC systems 100, 200, 300, 400 and feedback to improve operations over time. Therefore, a database in the computer readable medium 504 may record temperatures from the sensors 115, 215, 315, 415, 417 on the outdoor heat exchangers 108, 208, 308, 408, 409, and/or operational parameters of the compressors 104, 204, 304, 404, 405 for use as historical measurements and historical operating conditions to train the machine learning model 506 for use in the HVAC systems 100, 200, 300, 400. For example, the machine learning model 506 may correlate historical measurements from the sensors to the historical operating conditions of the particular HVAC system 100, 200, 300, 400 (e.g., stored in the database) to predictively control the HVAC system 100, 200, 300, 400 using current measurements from the sensors to control when and how the HVAC systems operate (e.g., to initiate the defrost mode before the sensors 115, 215, 315, 415, 417 report temperatures at or below 0° C. (32° F.) or ice formation otherwise begins on the outdoor heat exchangers 108, 208, 308, 408, 409).

In some examples, different deployments of the HVAC system 100, 200, 300, 400 may individually train a locally deployed machine learning model 506 to react differently to current sensor measurements and operating conditions according to the differences in the environments in which the different HVAC systems 100, 200, 300, 400 are deployed, mechanical differences between the different HVAC systems 100, 200, 300, 400, differences in the age or length of service between the different HVAC systems 100, 200, 300, 400, or the like. In some examples, the historical data from one or multiple deployments of HVAC systems 100, 200, 300, 400 may be used as a base or pre-trained machine learning model 506 in the controller 500 for use in newly deployed HVAC systems 100, 200, 300, 400. Additionally or alternatively, historical data that are aggregated from multiple deployments may be used to train a machine learning model 506 that is included for use in the controllers 500 of multiple deployments of the HVAC systems 100, 200, 300, 400, thereby allowing for collective learning and control in addition to or alternatively to individual learning and control.

In various examples the machine learning model 506 may include various algorithms used to provide "artificial intelligence" to the controller. These machine learning models 506 may include reinforcement learning algorithms, Artificial Neural Networks, decision trees, support vector machines, genetic algorithms, Bayesian networks, or the like. The models may include publicly available services (e.g., via an Application Program Interface with the provider) as well as purpose-trained or proprietary services, which may be deployed locally or accessed via a networked service. One of ordinary skill in the relevant art will recognize that different domains may benefit from the use of different machine learning models 506, which may be continuously or periodically trained based on received feedback. Accordingly, the person of ordinary skill in the relevant art will be able to select or design an appropriate machine learning model 506 based on the details provided in the present disclosure to predictively set operating parameters for the HVAC systems 100, 200, 300, 400 based on correlations found between current sensors readings and historical sensor readings and between the corresponding historical states of the HVAC systems 100, 200, 300, 400 and the desired current states of the HVAC systems 100, 200, 300, 400.

In addition to the embodiments described above, many examples of specific combinations are within the scope of the disclosure, some of which are detailed below:

Example 1—A method of defrosting a heating, ventilation, and air conditioning (HVAC) system operable to use a refrigerant to heat or cool an indoor space, the method comprising:

compressing the refrigerant with a compressor;

flowing the refrigerant in a refrigerant circuit between an indoor heat exchanger an expansion device and an outdoor heat exchanger, wherein the refrigerant flows through the expansion device in a first direction in a cooling mode and in a second direction, opposite the first direction, in a heating mode; and wherein in a defrost mode:

flowing the refrigerant in the second direction in the refrigerant circuit;

actuating the first three-way valve to divert some or all of the refrigerant from the refrigerant circuit and through a defrost line, a defrost passage in the outdoor heat exchanger, and a defrost return line;

defrosting the outdoor heat exchanger with the diverted refrigerant in the defrost passage; and flowing the diverted refrigerant in the defrost return line to return the diverted refrigerant to the refrigerant circuit upstream of the expansion device and downstream of the indoor heat exchange with respect to the second direction.

Example 2—The method of example 1, further comprising:

collecting measurements of an outdoor air temperature and an outdoor humidity;

storing the measurements in a database;

predicting a formation of ice on the outdoor heat exchanger with a machine learning model and the measurements; and actuating the first three-way valve based on the prediction to begin the defrost mode before ice forms on the outdoor heat exchanger.

Example 3—The method of example 1, further comprising:

measuring a temperature of the outdoor heat exchanger; and actuating the first three-way valve in response to the temperature.

Example 4—The method of example 1, wherein the actuating the first three-way valve flows refrigerant from a position upstream from the indoor heat exchanger with respect to the second direction.

Example 5—The method of example 1, wherein the defrost passage in the outdoor heat exchanger includes a plurality of passages distributed between a first end and a second end of the outdoor heat exchanger and the distribution of the plurality of passages is denser along the first end relative to the second end, and wherein the defrosting of the outdoor heat exchanger defrosts the first end of the outdoor heat exchanger before the second end.

Example 6—The method of example 1, wherein the actuating of the first three-way valve flows refrigerant from a position downstream from the indoor heat exchanger with respect to the second direction.

Example 7—The method of example 6 further comprising actuating a bypass valve to flow at least a portion of the refrigerant from the compressor through a bypass passage to the first three-way valve, thereby bypassing the indoor heat exchanger.

Example 8—The method of example 1, wherein the HVAC system further comprises a refrigerant line between the expansion device and a primary passage of the outdoor heat exchanger; a valve connected between the defrost line and the refrigerant line; and a second three-way valve connected between the defrost return line, the defrost passage, and the primary passage, the method in the defrost mode further comprising actuating the valve closed to direct the diverted refrigerant flow in the defrost line through the defrost passage in the outdoor heat exchanger; actuating the second three-way valve to direct the diverted refrigerant flow from the defrost passage to the defrost return line.

Example 9—A method of defrosting a multi-circuit heating, ventilation, and air conditioning (HVAC) system operable to use a first refrigerant and a second refrigerant to heat or cool an indoor space, the method comprising:

compressing the first refrigerant with a first compressor;

flowing the first refrigerant in a first refrigerant circuit between an indoor heat exchanger a first expansion device and a first outdoor heat exchanger, wherein the first refrigerant flows through the first expansion device in a first direction in a cooling mode and in a second direction, opposite the first direction, in a heating mode;

flowing the second refrigerant in a second refrigerant circuit between the indoor heat exchanger a second expansion device and a second outdoor heat exchanger, wherein the second refrigerant flows through the second expansion device in a first direction in a cooling mode and in a second direction, opposite the first direction, in a heating mode; and wherein in a defrost mode, the method further comprises:

flowing the first refrigerant in the second direction in the first refrigerant circuit;

actuating the first three-way valve to divert some or all of the first refrigerant from the first refrigerant circuit and through a first defrost line, a first defrost passage in the first outdoor heat exchanger, and a first defrost return line;

defrosting the first outdoor heat exchanger with the diverted first refrigerant in the first defrost passage; and flowing the diverted first refrigerant in the first defrost return line to return the diverted first refrigerant to the first refrigerant circuit upstream of the first expansion device and downstream of the indoor heat exchanger with respect to the second direction.

Example 10—The method of example 9, further comprising:

collecting measurements an outdoor air temperature and an outdoor humidity;

storing the measurements in a database;

predicting a formation of ice on the first outdoor heat exchanger and the second outdoor heat exchanger with a machine learning model and the measurements; and actuating the first three-way valve based on the prediction to begin the defrost mode before ice forms on the first outdoor heat exchanger or the second outdoor heat exchanger.

Example 11—The method of example 9, wherein in the defrost mode, the method further comprises:

flowing the second refrigerant in the second direction in the second refrigerant circuit;

actuating the second three-way valve to divert some or all of the second refrigerant from the second refrigerant circuit and through a second defrost line, a second defrost passage in the second outdoor heat exchanger, and a second defrost return line;

defrosting the second outdoor heat exchanger with the diverted second refrigerant in the second defrost passage; and flowing the diverted second refrigerant in the second defrost return line to return the diverted second refrigerant to the second refrigerant circuit upstream of the second expansion device and downstream of the indoor heat exchanger with respect to the second direction.

Example 12—The method of example 11, wherein the multi-circuit HVAC system further includes a controller, the method further comprising operating the controller to alternate actuation of the first three-way valve and the second three-way valve such that the first outdoor heat exchanger is defrosted while the second refrigerant circuit remains in the heating mode and the second outdoor heat exchanger is defrosted while the first refrigerant circuit remains in the heating mode, such that the indoor heat exchanger maintains some degree of heating during the defrost modes of both the first refrigerant circuit and the second refrigerant circuit.

Example 13—The method of example 11, further comprising operating at least one of the first or the second defrost circuits to defrost both the first and the second outdoor heat exchangers.

Example 14—The method of example 13, wherein the multi-circuit HVAC system further includes a controller, the method further comprising actuating the first three-way valve with the controller to defrost the first outdoor heat exchanger and the second outdoor heat exchanger in response to a temperature of at least one of the first outdoor heat exchanger or the second outdoor heat exchanger.

Example 15—The method of example 13, wherein the actuating the first three-way valve flows refrigerant from a position upstream from the first indoor heat exchanger with respect to the second direction of the first refrigerant circuit.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

Optionally, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A heating, ventilation, and air conditioning (HVAC) system operable to use a refrigerant to heat or cool an indoor space and comprising:

a compressor, an outdoor heat exchanger, an indoor heat exchanger, an expansion device, and a four-way valve connected together as a refrigerant circuit, wherein the four-way valve is operable to flow the refrigerant through the expansion device in a first direction in a cooling mode and in a second direction, opposite the first direction, in a heating mode; and a defrost circuit connected to the refrigerant circuit and comprising a first three-way valve, a defrost line, a defrost passage in the outdoor heat exchanger, and a defrost return line;

wherein when the HVAC system is in a defrost mode:

the four-way valve is operable to direct the refrigerant flow in the second direction through the outdoor heat exchanger;

the first three-way valve is operable to divert some or all of the refrigerant from the refrigerant circuit and through the defrost circuit to defrost the outdoor heat exchanger; and the defrost return line returns the diverted refrigerant to the refrigerant circuit upstream of the expansion device and downstream of the indoor heat exchanger with respect to the second direction.

2. The HVAC system of claim 1, further comprising a controller configured to:

collect measurements of an outdoor air temperature and an outdoor humidity;

store the measurements in a database;

use a machine learning model and the measurements to predict a formation of ice on the outdoor heat exchanger; and actuate the first three-way valve based on the prediction to begin the defrost mode before the formation of ice on the outdoor heat exchanger.

3. The HVAC system of claim 1, further comprising a controller programmed to actuate the first three-way valve in response to a temperature of the outdoor heat exchanger.

4. The HVAC system of claim 1, wherein the first three-way valve is positioned upstream from the indoor heat exchanger with respect to the second direction.

5. The HVAC system of claim 1, wherein the defrost passage in the outdoor heat exchanger includes a plurality of passages distributed between a first end and a second end of the outdoor heat exchanger, and wherein the distribution of the plurality of passages is denser along the first end relative to the second end, such that the first end receives more heat from the refrigerant in the defrost circuit during the defrost mode.

6. The HVAC system of claim 1, wherein the compressor comprises a variable speed compressor.

7. The HVAC system of claim 1, wherein the outdoor heat exchanger comprises:

a primary slab including a primary passage configured to allow the refrigerant to flow in the second direction in the defrost mode; and a defrost slab including the defrost passage;

wherein the defrost slab is separated from the primary slab, and is configured in the defrost mode to transfer heat to the primary slab via an outdoor airflow.

8. The HVAC system of claim 1, wherein the first three-way valve is positioned downstream from the indoor heat exchanger with respect to the second direction.

9. The HVAC system of claim 8, further comprising a bypass valve operable to control flow of at least a portion of the refrigerant from the compressor through a bypass line bypassing the indoor heat exchanger.

10. The HVAC system of claim 1, further comprising:

a refrigerant line between the expansion device and a primary passage of the outdoor heat exchanger;

a valve connected between the defrost line and the refrigerant line; and a second three-way valve connected between the defrost return line, the defrost passage, and the primary passage;

wherein when the system is in the defrost mode:

the valve is partially open to direct a first portion of the diverted refrigerant flow in the defrost line through the defrost passage in the outdoor heat exchanger and to direct a second portion of the diverted refrigerant flow to the primary passage in the outdoor heat exchanger to increase temperature of the refrigerant downstream of the expansion device; and the second three-way valve is configured to direct the diverted refrigerant flow from the defrost passage to the defrost return line.

11. The HVAC system of claim 1, further comprising:

a refrigerant line between the expansion device and a primary passage of the outdoor heat exchanger;

a valve connected between the defrost line and the refrigerant line; and a second three-way valve connected between the defrost return line, the defrost passage, and the primary passage;

wherein when the system is in the defrost mode:

the valve is closed to direct the diverted refrigerant flow in the defrost line through the defrost passage in the outdoor heat exchanger; and the second three-way valve directs the diverted refrigerant flow from the defrost passage to the defrost return line.

12. The HVAC system of claim 11, wherein in the heating or cooling mode:

the first three-way valve is operable to prevent refrigerant flow to the defrost line and operable to flow substantially all the refrigerant between the four-way valve and the indoor heat exchanger;

the valve is operable to open and provide fluid communication between the expansion device and both the primary passage and the defrost passage of the outdoor heat exchanger; and the second three-way valve is operable provide fluid communication between the four-way valve and both the primary passage and the defrost passage of the outdoor heat exchanger, so that both the primary passage and the defrost passage are operable to use the refrigerant from the refrigerant circuit to heat or cool the indoor space.

13. A multi-circuit heating, ventilation, and air conditioning (HVAC) system for use with a first refrigerant and a second refrigerant, the multi-circuit HVAC system comprising:

a first refrigerant circuit for the first refrigerant comprising a first compressor, a first outdoor heat exchanger, a first expansion device, and an indoor heat exchanger;

a second refrigerant circuit for the second refrigerant, the second refrigerant circuit being fluidically isolated from the first refrigerant circuit and comprising a second compressor, a second outdoor heat exchanger, a second expansion device, and the indoor heat exchanger; and a first defrost circuit connected to and branching from the first refrigerant circuit in two positions, the first defrost circuit comprising a first three-way valve, a first defrost line, a first defrost passage in the first outdoor heat exchanger, and a first defrost return line;

wherein when the HVAC system is in a defrost mode:

the first three-way valve is operable to divert some or all of the first refrigerant from the first refrigerant circuit and through the first defrost circuit to defrost the first outdoor heat exchanger; and the first defrost return line returns the diverted first refrigerant to the first refrigerant circuit upstream of the first expansion device and downstream of the indoor heat exchanger.

14. The multi-circuit HVAC system of claim 13, further comprising a controller configured to:

collect measurements of an outdoor air temperature and an outdoor humidity;

store the measurements in a database;

use a machine learning model and the measurements to predict a formation of ice on the first outdoor heat exchanger and the second outdoor heat exchanger; and actuate the first three-way valve based on the prediction to begin the defrost mode before the formation of ice on the first outdoor heat exchanger or the second outdoor heat exchanger.

15. The multi-circuit HVAC system of claim 13, further comprising:

a second defrost circuit connected to and branching from the second refrigerant circuit in two positions, the second defrost circuit comprising a second three-way valve, a second defrost line, a second defrost passage in the second outdoor heat exchanger, and a second defrost return line;

wherein when the HVAC system is in the defrost mode:

the second three-way valve is operable to divert some or all of the second refrigerant from the second refrigerant circuit and through the second defrost circuit to defrost the second outdoor heat exchanger; and the second defrost return line returns the diverted second refrigerant to the second refrigerant circuit upstream of the second expansion device and downstream of the indoor heat exchanger.

16. The multi-circuit HVAC system of claim 15, further comprising a controller programmed to alternate actuation of the first three-way valve and the second three-way valve such that the first outdoor heat exchanger is defrosted while the second refrigerant circuit remains in the heating mode and the second outdoor heat exchanger is defrosted while the first refrigerant circuit remains in the heating mode, such that the indoor heat exchanger maintains some degree of heating during the defrost modes of both the first refrigerant circuit and the second refrigerant circuit.

17. The multi-circuit HVAC system of claim 15, wherein the first outdoor heat exchanger and the second outdoor heat exchanger are thermally connected such that the operation of at least one of the first or the second defrost circuits defrosts both the first and the second outdoor heat exchangers.

18. The multi-circuit HVAC system of claim 17, further comprising a controller programmed to actuate the first three-way valve, to defrost the first outdoor heat exchanger and the second outdoor heat exchanger, in response to a temperature of at least one of the first outdoor heat exchanger or the second outdoor heat exchanger.

19. The multi-circuit HVAC system of claim 17, wherein the first three-way valve is positioned upstream from the first indoor heat exchanger, when the first refrigerant circuit is in the heating mode.

20. A method of defrosting a heating, ventilation, and air conditioning (HVAC) system operable to use a refrigerant to heat or cool an indoor space, the method comprising:

compressing the refrigerant with a compressor;

flowing the refrigerant in a refrigerant circuit between an indoor heat exchanger an expansion device and an outdoor heat exchanger, wherein the refrigerant flows through the expansion device in a first direction in a cooling mode and in a second direction, opposite the first direction, in a heating mode; and wherein in a defrost mode:

flowing the refrigerant in the second direction in the refrigerant circuit;

actuating the first three-way valve to divert some or all of the refrigerant from the refrigerant circuit and through a defrost line, a defrost passage in the outdoor heat exchanger, and a defrost return line;

defrosting the outdoor heat exchanger with the diverted refrigerant in the defrost passage; and flowing the diverted refrigerant in the defrost return line to return the diverted refrigerant to the refrigerant circuit upstream of the expansion device and downstream of the indoor heat exchange with respect to the second direction.

* * * * *